US007394397B2

(12) United States Patent
Nguyen et al.

(10) Patent No.: US 7,394,397 B2
(45) Date of Patent: Jul. 1, 2008

(54) STANDBY LOSS PREVENTION MODULE, TRANSFORMER SYSTEM INCLUDING SAME, AND METHODS RELATING THERETO

(76) Inventors: Hap Nguyen, 15391 Purdy St., Westminster, CA (US) 92683; Chilinh Nguyen, 17461 Pleasant Ct., Fountain Valley, CA (US) 92708

( * ) Notice: Subject to any disclaimer, the term of this patent is extended or adjusted under 35 U.S.C. 154(b) by 320 days.

(21) Appl. No.: 11/034,226

(22) Filed: Jan. 12, 2005

(65) Prior Publication Data

US 2005/0237036 A1 Oct. 27, 2005

Related U.S. Application Data

(60) Provisional application No. 60/537,107, filed on Jan. 17, 2004, provisional application No. 60/583,282, filed on Jun. 25, 2004.

(51) Int. Cl.
*G08B 23/00* (2006.01)

(52) U.S. Cl. ..... 340/693.3; 340/693.1

(58) Field of Classification Search ..... 340/693.3, 340/693.1, 3.1, 660, 661; 455/334
See application file for complete search history.

(56) References Cited

U.S. PATENT DOCUMENTS 4,962,373 A * 10/1990 Sirois ..... 340/691.1
5,717,386 A * 2/1998 Sakagami et al. ..... 340/3.1
6,587,047 B2 * 7/2003 Nilsson et al. ..... 340/554
7,064,662 B2 * 6/2006 Goggin ..... 340/539.32

* cited by examiner

*Primary Examiner*—John Tweel, Jr.
(74) *Attorney, Agent, or Firm*—DB Technical Consulting; Donald Bollella

(57) ABSTRACT

Methods and apparatus for controlling power to a load device. The apparatus include a standby loss prevention module or a transformer system including the module. The module and system are directed to sensing load requirements and controlling a transformer accordingly to reduce power consumption when the load is in a stand by mode. One method includes interposing a control switch between an electrical supply and a load device, determining when the load device requires full-level operational power, activating the control switch to interpose a step-up transformer between the electrical supply and the load device, providing full-level operational power to the load device, and deactivating the step-up transformer when the load device is not in use.

24 Claims, 21 Drawing Sheets

STANDBY LOSS PREVENTION MODULE, TRANSFORMER SYSTEM INCLUDING SAME, AND METHODS RELATING THERETO

CROSS REFERENCE TO RELATED APPLICATIONS

The present application claims the benefit of priority from U.S. Provisional Application Ser. No. 60/537,107 filed Jan. 17, 2004 and U.S. Provisional Application Ser. No. 60/583,282 filed Jun. 25, 2004 both of which are incorporated herein by reference in their entirety.

BACKGROUND OF THE INVENTION

1. Field of the Invention

This invention relates in general to electronic control devices and, in particular, to electronic control devices for regulating supply power to electrical apparatus. More specifically, but without restriction to the particular embodiments hereinafter described in accordance with the best mode of practice, this invention relates to a standby loss prevention module and transformer system that may be employed in conjunction with a wide variety of electrical apparatus including industrial motors, large-volume air compressors, tanning equipment used in tanning salons, and other electrical apparatus requiring a transformer action in electrical power as provided by the mains or grid connection.

2. General Discussions and Related Art

As the demand for electrical power grows along with economic growth and population increases, there is a need for providing energy savings devices and methods in the employment of electrical-power consuming devices so that the existing grid is not over-loaded. Such a need exists currently because the time for building and bringing on-line additional power plants is long-term compared to the short run seasonal spikes in demand for electrical power, and the current general trend of a steady increase in industrial and consumer demand for electrical power.

Recent events in different geographical regions of the United States have witnessed both sky-rocketing electrical power energy cost increases and massive black-outs due to the age of the grid and over demand by consumers for electrical power. Undesirable and disruptive brown-outs and rolling black-outs have also become more common and necessary in recent times due the ever increasing demands for electrical power.

The increased demand for electrical power simply cannot be met by building new power plants because the lag time associated with bringing new power plants on-line or upgrading existing power plants is relatively long compared to the fluctuating but steadily increasing demands for electrical power. Thus there is a current need for providing lost cost electrical control devices for conserving the use of electrical power.

More specifically, there is a great number of equipment and devices designed to work with 220 vac or 240 vac. U.S. power generators provide either 208 vac or 240 vac. Therefore a booster transformer is required to increase (boost) voltage or a decrease (buck) voltage to supply correct power to a piece of equipment.

There are 500,000 tanning beds, a few million industrial air compressors, and millions of other industrial devices such as flow-solder machines, conveyor belts, motors, and other industrial electrical devices that employ transformers to boost power supply. The problem with these transformers is that they are wired in the ON state at all times. They thus draw electricity 24 hours a day even though the devices are only needed a few hours each day. A great amount of energy is wasted during those idle hours.

The present invention is designed to solve this problem. The device of the present invention enables the transformer when the load device is ON and disconnects it when load device goes OFF.

OBJECTS AND SUMMARY OF THE INVENTION

It is, therefore, an object of the present invention to provide electrical devices with reduced power requirements.

Another object of this invention is to reduce power costs associated with operating electrical equipment.

Still another object of the invention is to provide a standby loss prevention transformer, which disables itself when the load is not operational.

It is a further object of the present invention to provide a sensing and switching module that can be connected to any conventional transformer to convert it into a power efficient transformer.

It is yet a further object of the present invention to provide a remote controllable module for reducing standby losses in transformers.

Yet another object of the invention is to provide a wireless standby loss prevention module that can be connected to far apart load and transformer without requiring additional long running wires.

A further object of the invention is to provide an improved tanning device with a standby loss prevention module.

These and other objects are attained in accordance with the present invention wherein there is provided a standby loss prevention module for transformers. The module includes a sensor connected between the output of the transformer and the load through a communication connection for detecting the mode of load operation and communicating a corresponding signal. A control switch connected to the transformer and sensor through the communicating connection is employed for receiving a signal corresponding to the mode of operation of the load. The transformer is then accordingly activated or deactivated to thereby reduce the power consumed by the transformer.

According to a preferred embodiment of the invention, the sensor of the standby loss prevention module is provided with a voltage, current, or resistance sensor, or a combination thereof.

In accordance with another preferred embodiment, the standby loss prevention module for the transformers is provided with a voltage sensor including a coil, a potential divider, or feedback controlled voltage sensor, or a combination thereof.

According to yet another preferred embodiment of the present invention, the standby loss prevention module is provided with a voltage sensor which is an operational amplifier having a threshold defining member at the input, receiving its at least one input from the load supply and its output being connected to the control switch through the communication connection. The threshold defining member implemented as potential dividers connected to a second input of the operational amplifier.

In accordance with another aspect of the present invention, the standby loss prevention module for the advantageous use with transformers is provided with a current sensor including a sensing transformer connected in series with at least one supply line for sensing the current drawn by the load and converting it into a voltage signal. In this embodiment, there is also provided a rectifier and filter circuit connected at the output of the sensing transformer for rectifying and filtering the voltage signal and a communication link connected to the control switch for communicating a control signal for activating or deactivating the transformer.

According to yet another aspect of the present invention, the communication link of the current sensor and control switch of the standby loss prevention module may be any suitable communication link including, for example, physical wires or a wireless system or network including transmitters and receivers, transceivers, optically active devices, or any desired combination thereof.

In one preferred embodiment of the present invention, a wireless transmitter associated with the control switch of the standby loss prevention module is connected to sensors and the receiver is connected to the control switch.

In another preferred embodiment hereof, the optically active devices of standby loss prevention module include an opto-isolator.

According to a further aspect of the standby loss prevention module, the control switch is implemented as a semiconductor and/or spring based relay control switch connected to the communications link. Preferably the control switch is a triac device connected to the communication link.

In accordance with still a further aspect of this invention, the relay control switch may be advantageously provided with an additional conductor to short any secondary windings of the transformer for pressure regulator applications.

And according to still another implementation of the control switch of the present standby loss prevention module for transformers, an alternate preferred embodiment of the control switch is advantageously provided with a timing device to thereby control enable-time. This timing device may be implemented as any suitable timing device including a spring based timer, or a semi-conductor type microcontroller or micro-processor based timer.

In a particular embodiment of the present module, the relay control switch is provided with a jumper for remotely controlling operations.

According to another aspect of this invention, the associated transformers hereof are single or multi-phase transformers. The transformers can be booster type, buck type, or isolation type transformers.

In another preferred implementation of the present standby loss prevention module, the sensor and control switch are advantageously printed on a circuit board.

According to still yet another preferred embodiment of the present invention, there is provided an improved transformer having a standby loss prevention module which includes a sensor connected between the output of the transformer and a load. The sensor is connected through a communication link and is employed for detecting the mode of load operation and communicating a corresponding signal. The improved transformer is further provided with a control switch operatively connected to the transformer and sensor through the communicating link and suitably enabled to receive the signal corresponding to the mode of operation of the load. The control switch is thus accordingly employed to activate and deactivate the transformer thereby reducing the power consumed by the transformer. The sensor of the improved transformer including the standby loss prevention module may be a voltage, current, or resistance sensor.

In regard to another aspect of the improved transformer, the voltage sensor employed therein is any suitable voltage sensor including a coil, potential divider, or a feedback controlled voltage sensor. More particularly, the voltage sensor may be implemented as an operational amplifier having a threshold defining element at the input and receiving its at least one input from the load supply and its output being connected to the control switch through the communications link. In one particular embodiment, the threshold defining element is a potential divider connected to a second input of the operational amplifier.

In accordance with a preferred embodiment of the improved transformer having the standby loss prevention module of the present invention, the current sensor may include a sensing transformer connected in series with at least one supply line for sensing the current drawn by the load and converting it into a voltage signal. In this implementation there is provided a rectifier and a filter circuit connected at the output of the sensing transformer for rectifying and filtering a voltage signal, and there is provided a communication link connected to the control switch for communicating a control signal for activating and deactivating the transformer in a desired manner.

According to yet a further aspect of this embodiment of the improved transformer hereof, the communication link may be any suitable communication system or network including physical hard wiring, or wirelessly operative transmitters, receivers, transceivers, or optically active devices. More particularly in specific embodiments thereof, a wireless transmitter is connected to load sensors and a receiver is connected to the control switch. The optically active device may be implemented as an opto-isolator.

The control switch employed in these embodiments may be a semiconductor or spring based relay control switch connected to the communications link. In one preferred embodiment, the control switch is a triac device connected to the communication link. The control switch may be further advantageously provided with an additional conductor to short any secondary winding of the transformer for pressure regulator applications. In certain preferred embodiments hereof, the control switch is provided with a timing device which controls enable-time. Another control element may be provided with the control switch which is a jumper. The timing device is any suitable timing device including a spring based timer and a semi-conductor type microcontroller or microprocessor based timer.

As with the embodiments discussed above, the transformer of these embodiments is a single or multi-phase transformer and may be a booster type, buck type, or isolation type transformer. And the sensor and control switch may be advantageously printed on a circuit board.

And in accordance with yet a further aspect of the present invention there is provided and alternate improved transformer system. This transformer system includes a transformer having a plurality of primary coils which are selectively activated or deactivated according to the power requirements of the load. In an alternate embodiment thereof, the transformer system includes a plurality of transformers which are selectively activated or deactivated according to the power requirements of the load.

According to a preferred use aspect of the present invention, any of the above embodiments may be advantageously implemented in association with a tanning device such as a tanning bed to reduce the operation cost thereof by reducing its power consumption as discussed above.

The present invention is further directed to a method of reducing power consumption to an electrical device. This method includes the steps of interposing a control switch between an electrical supply and a load device, determining when the load device requires full-level operational power, activating the control switch to interpose a step-up transformer between the electrical supply and the load device, providing full-level operational power to the load device; and deactivating the step-up transformer when the load device is not in use.

BRIEF DESCRIPTION OF THE DRAWING FIGURES

Further objects of the present invention together with additional features contributing thereto and advantages accruing therefrom will be apparent from the following description of the preferred embodiments of the invention which are shown in the accompanying drawing figures, wherein.

Figure 4:
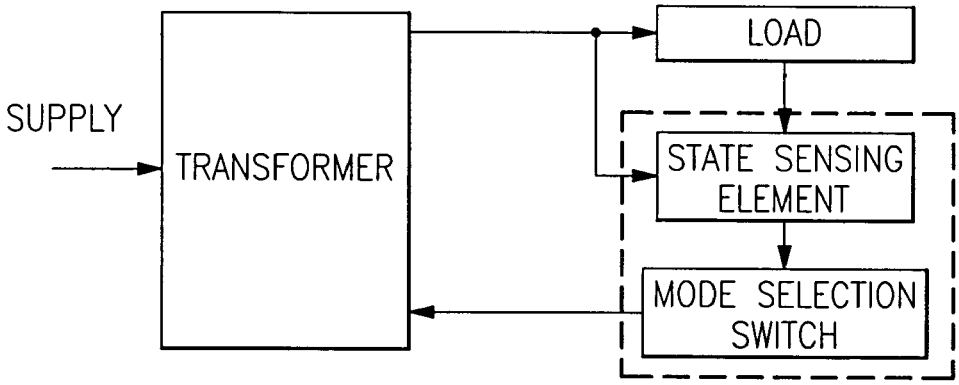
Figure 5:
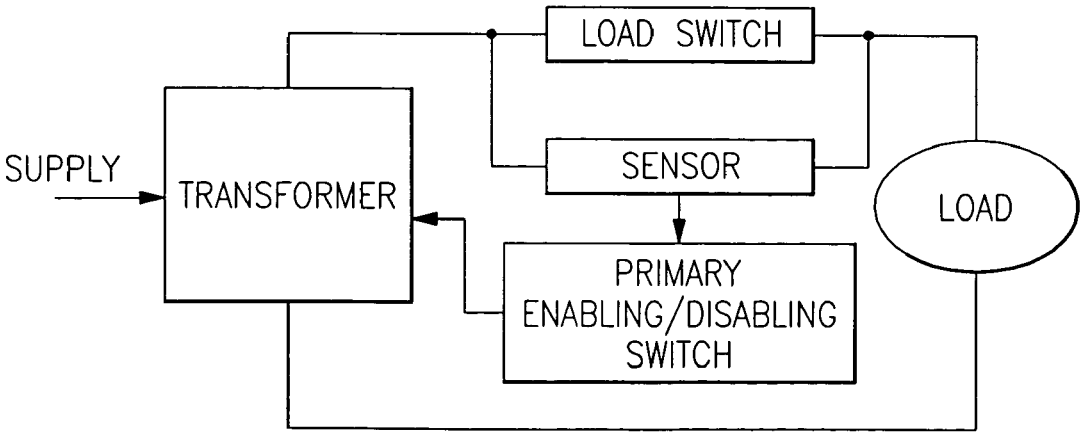
Figure 6:
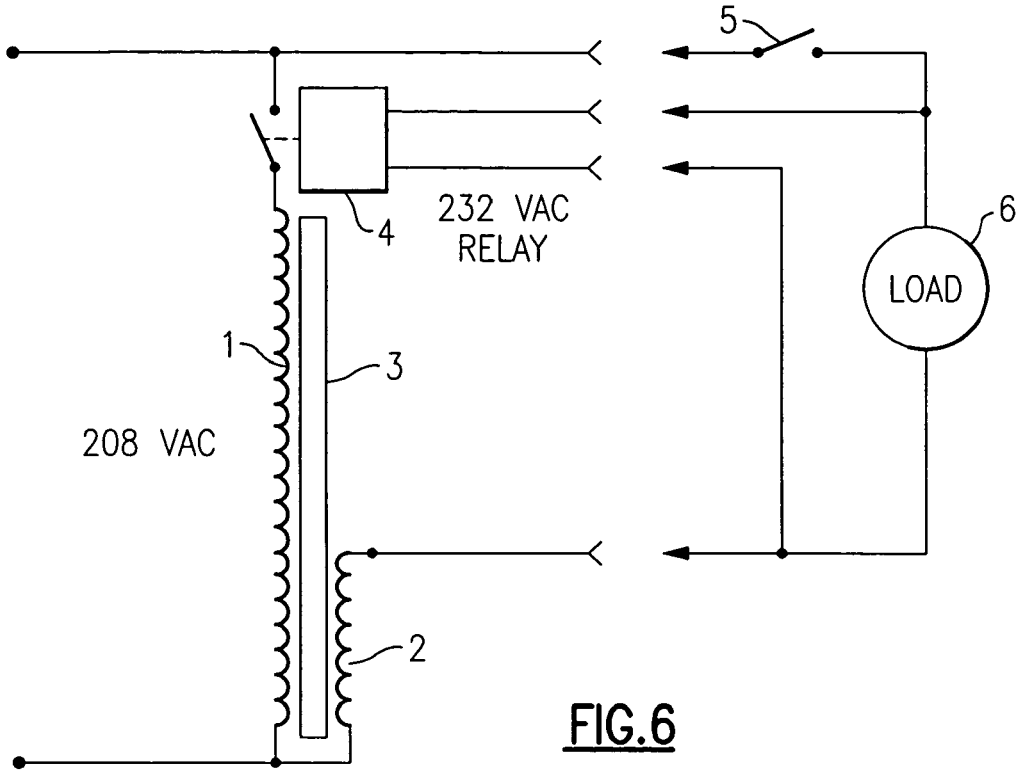
Figure 7:
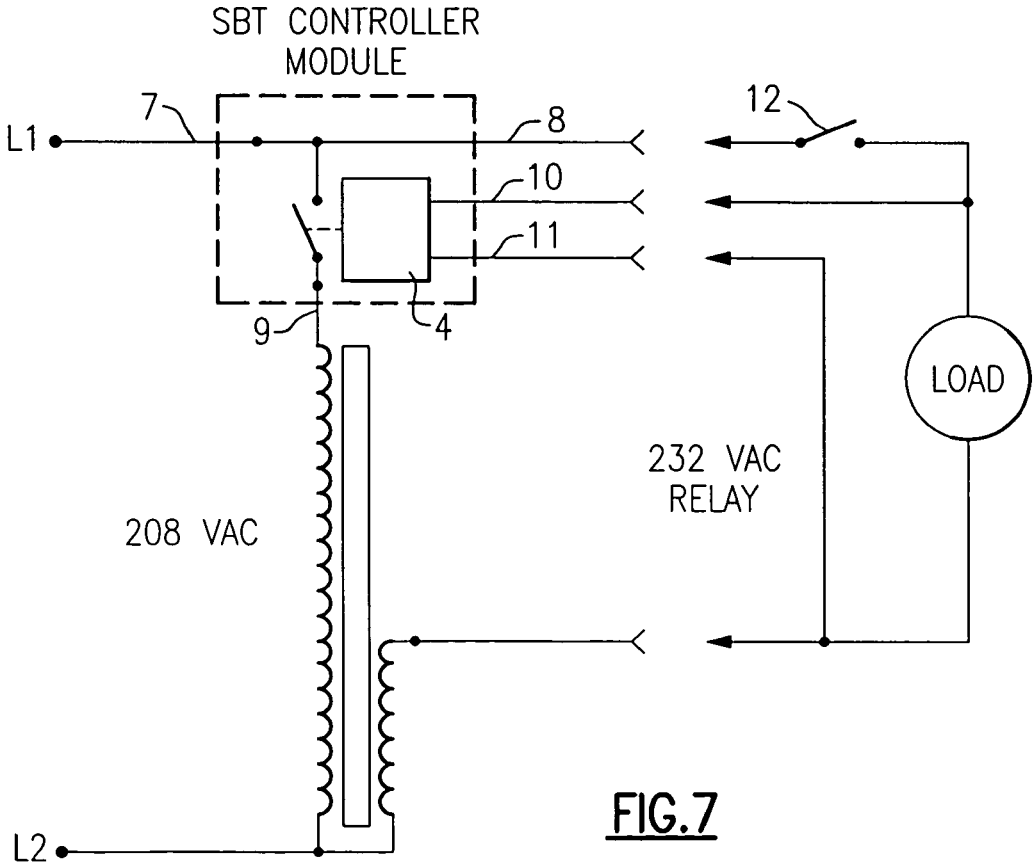
Figure 11:
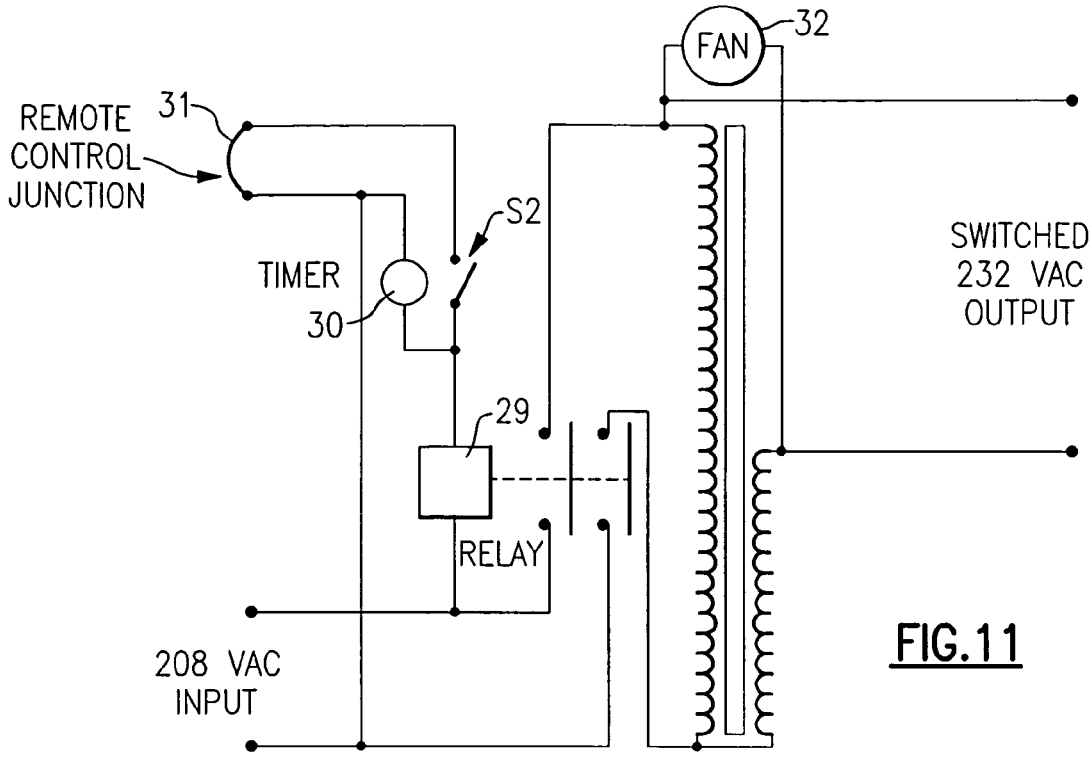
Figure 8:
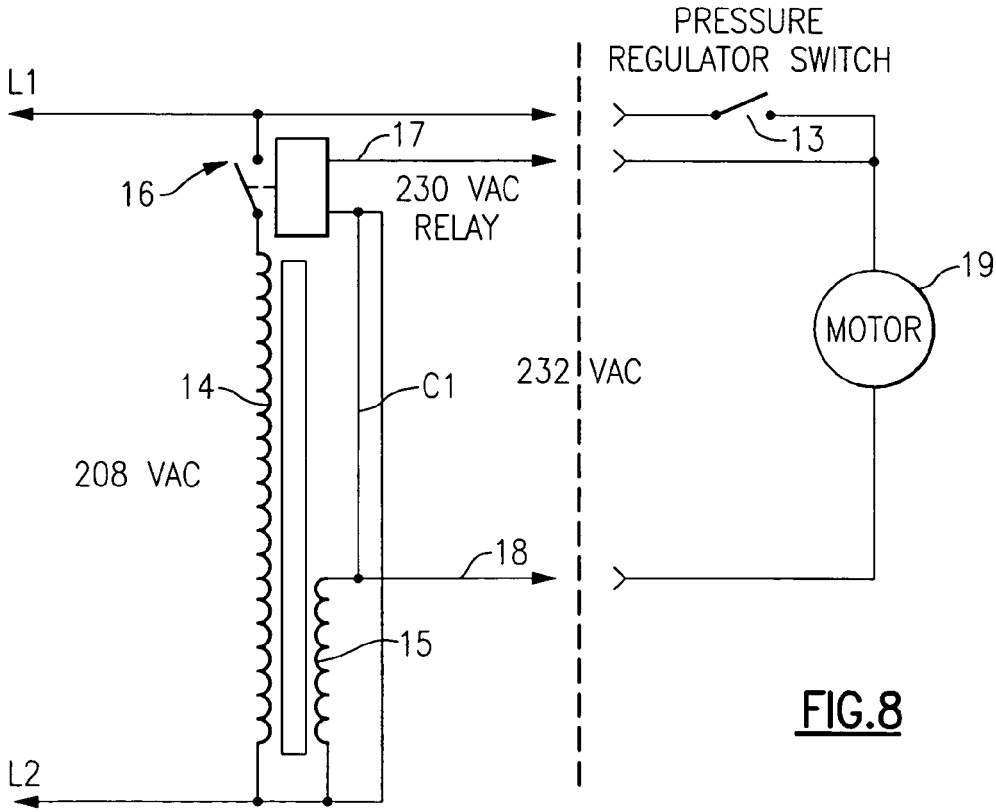
Figure 10:
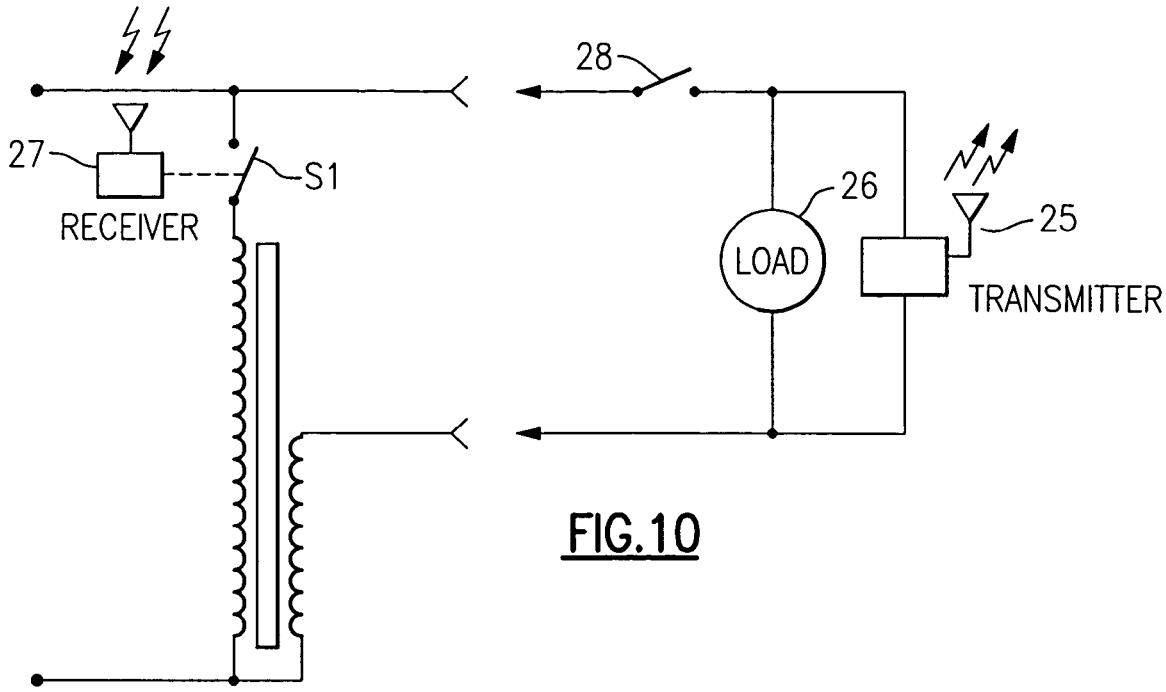
Figure 9:
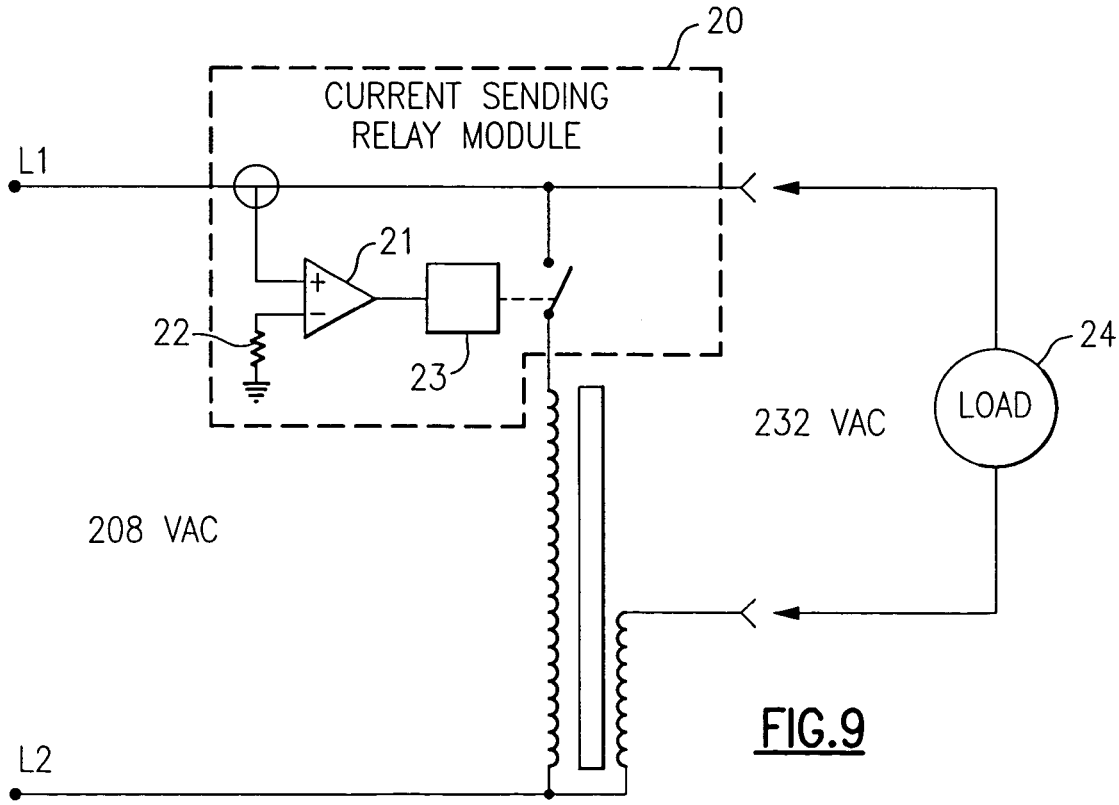
Figure 12:
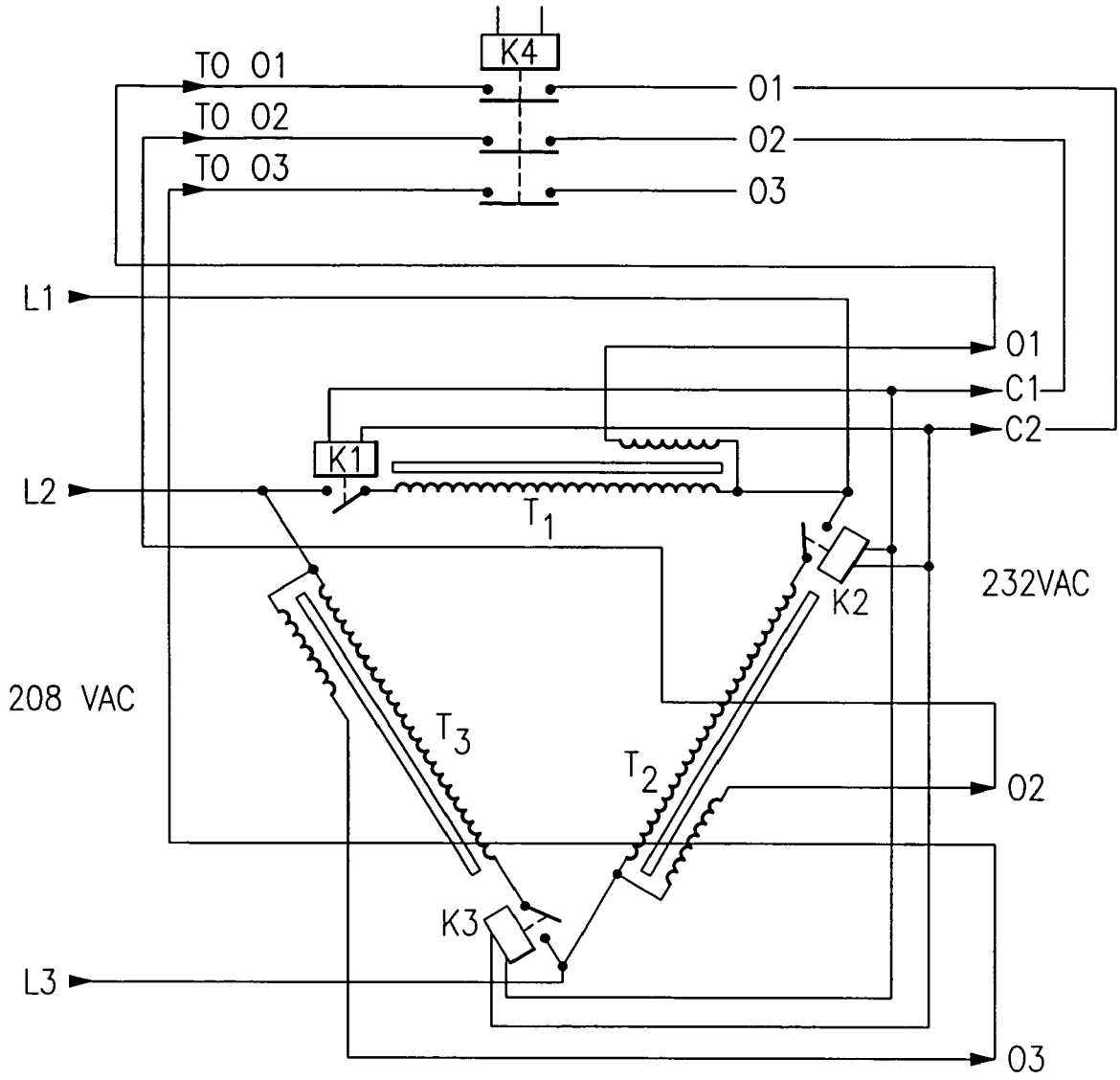
Figure 13:
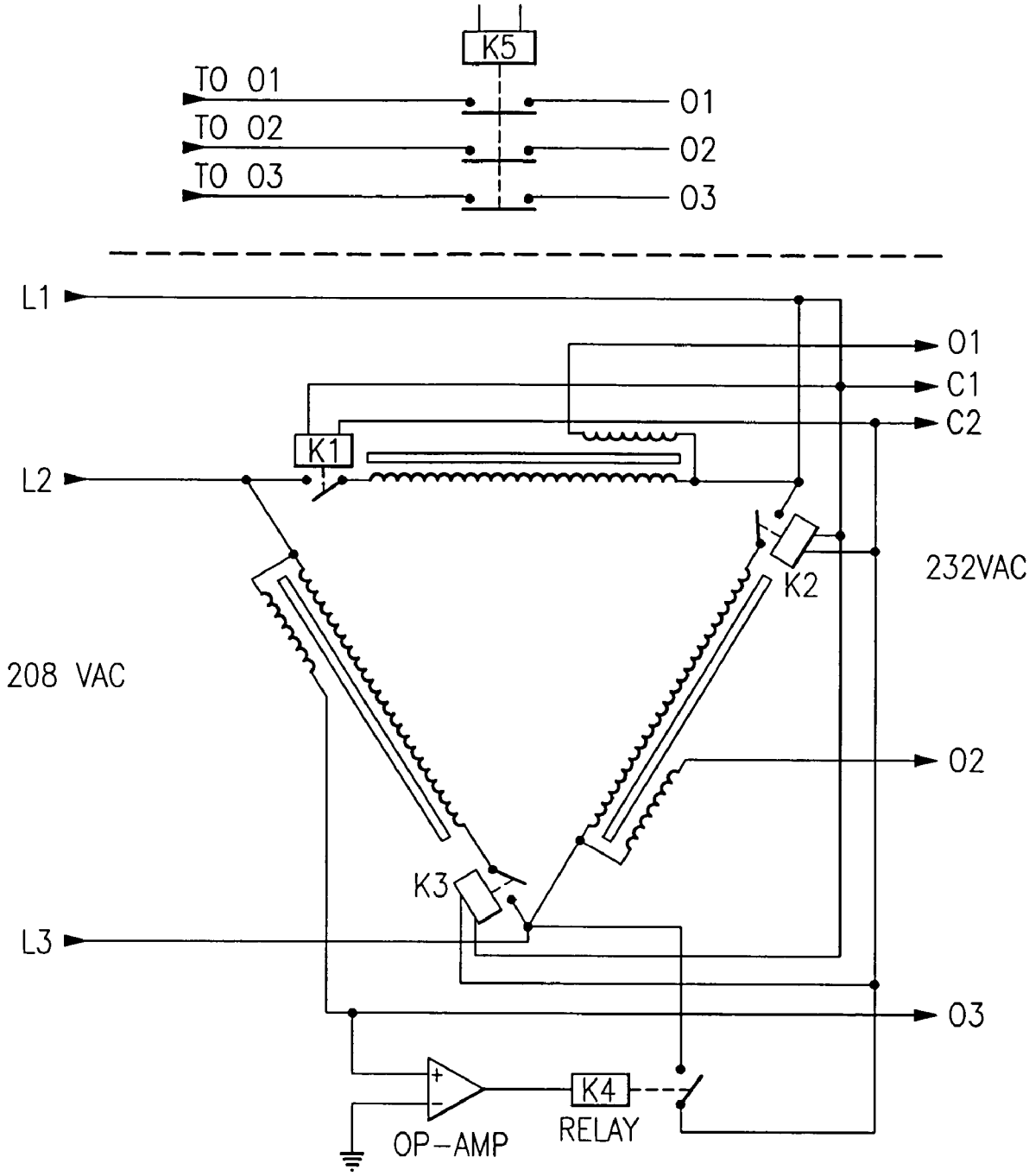
Figure 14:
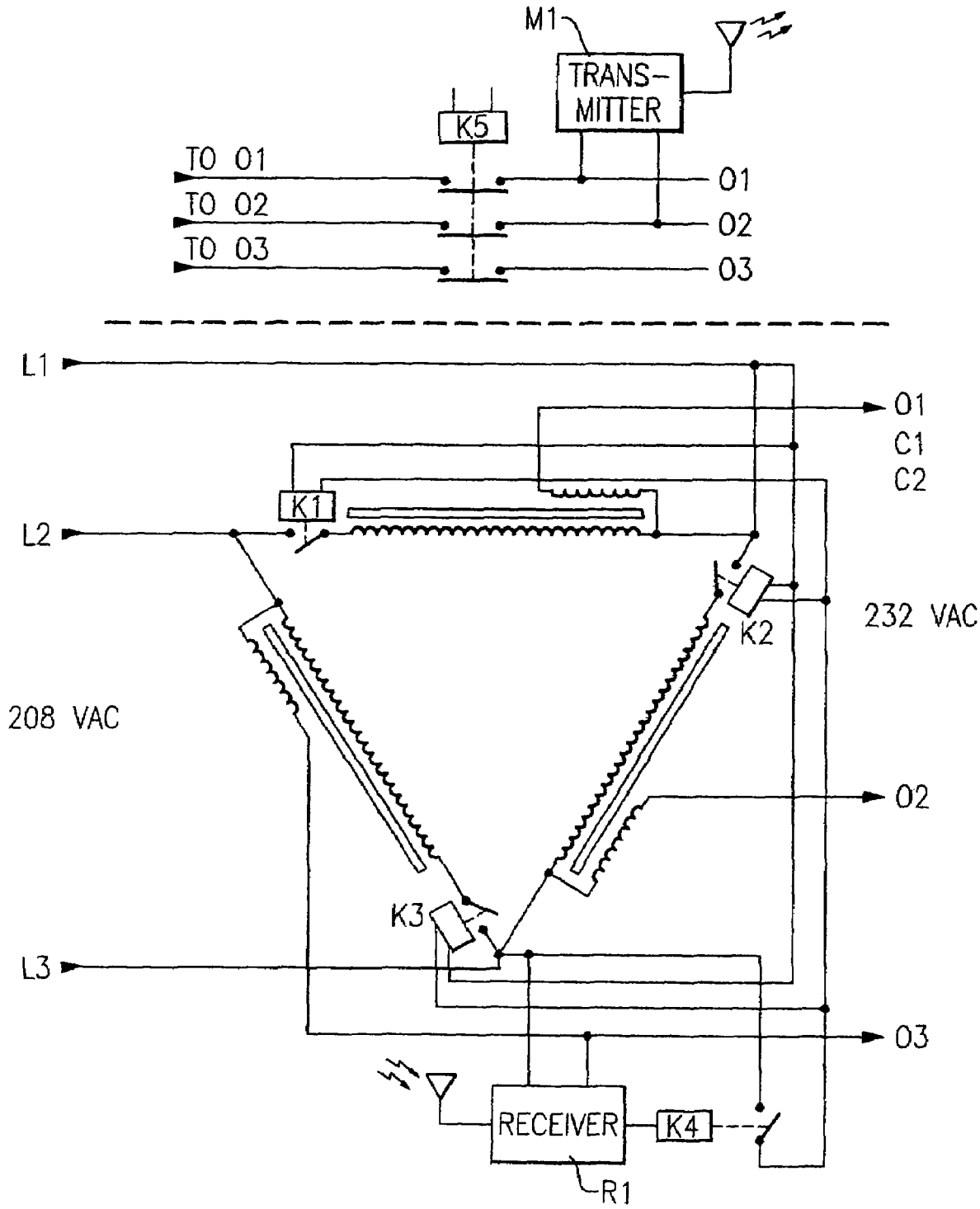
Figure 16:
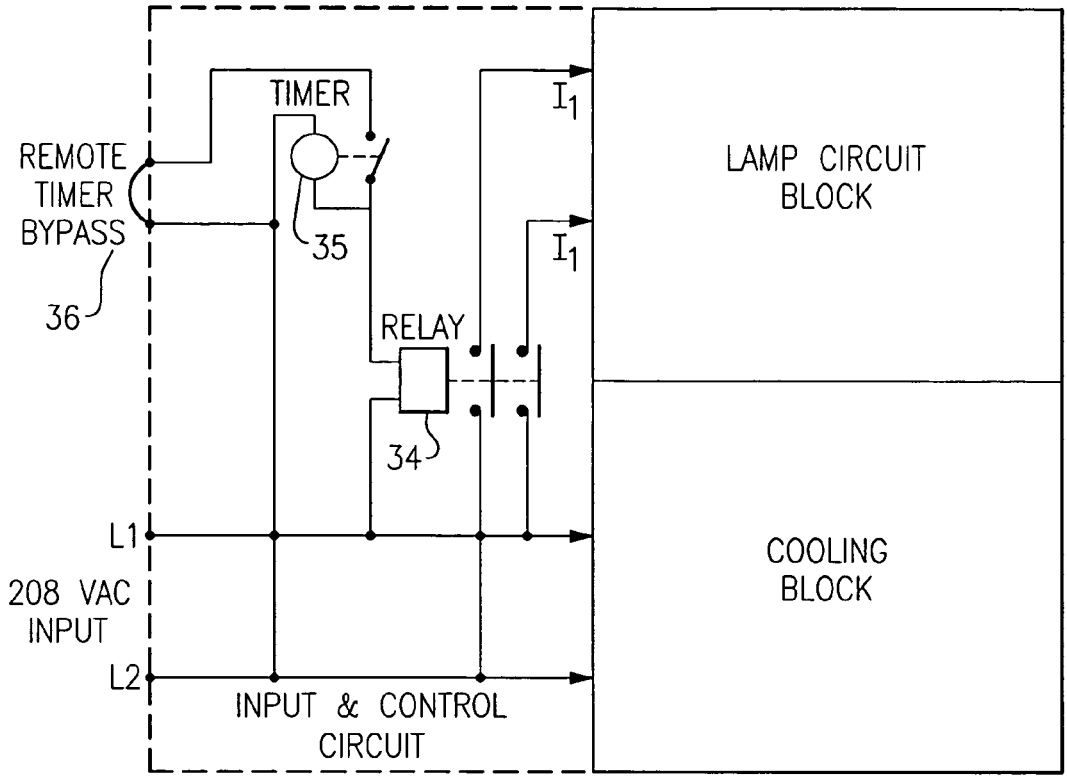
Figure 15:
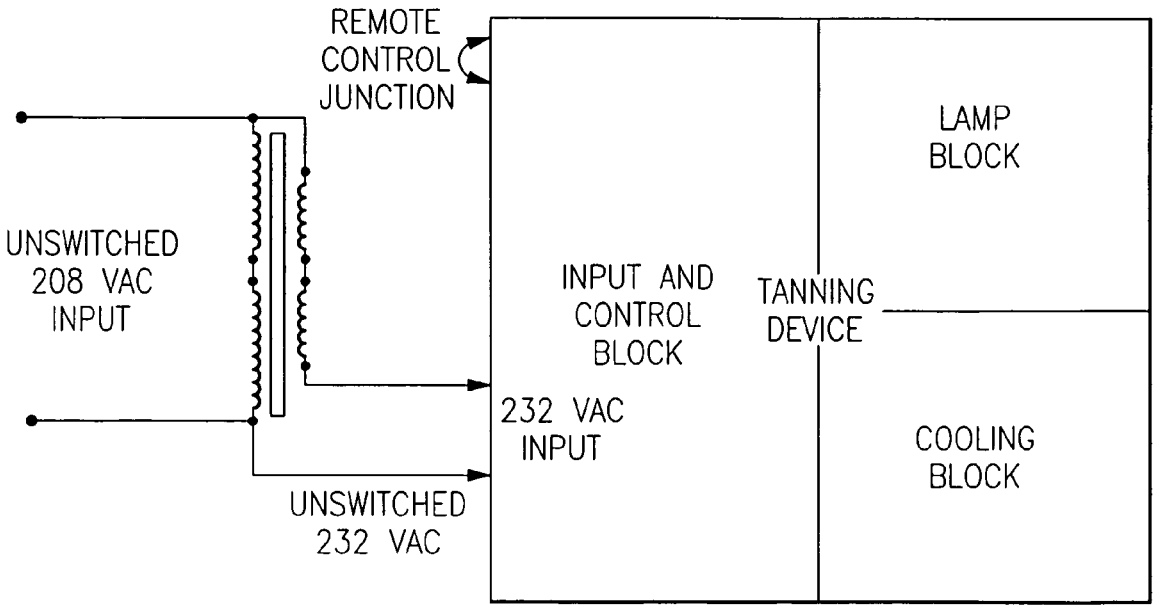
Figure 17:
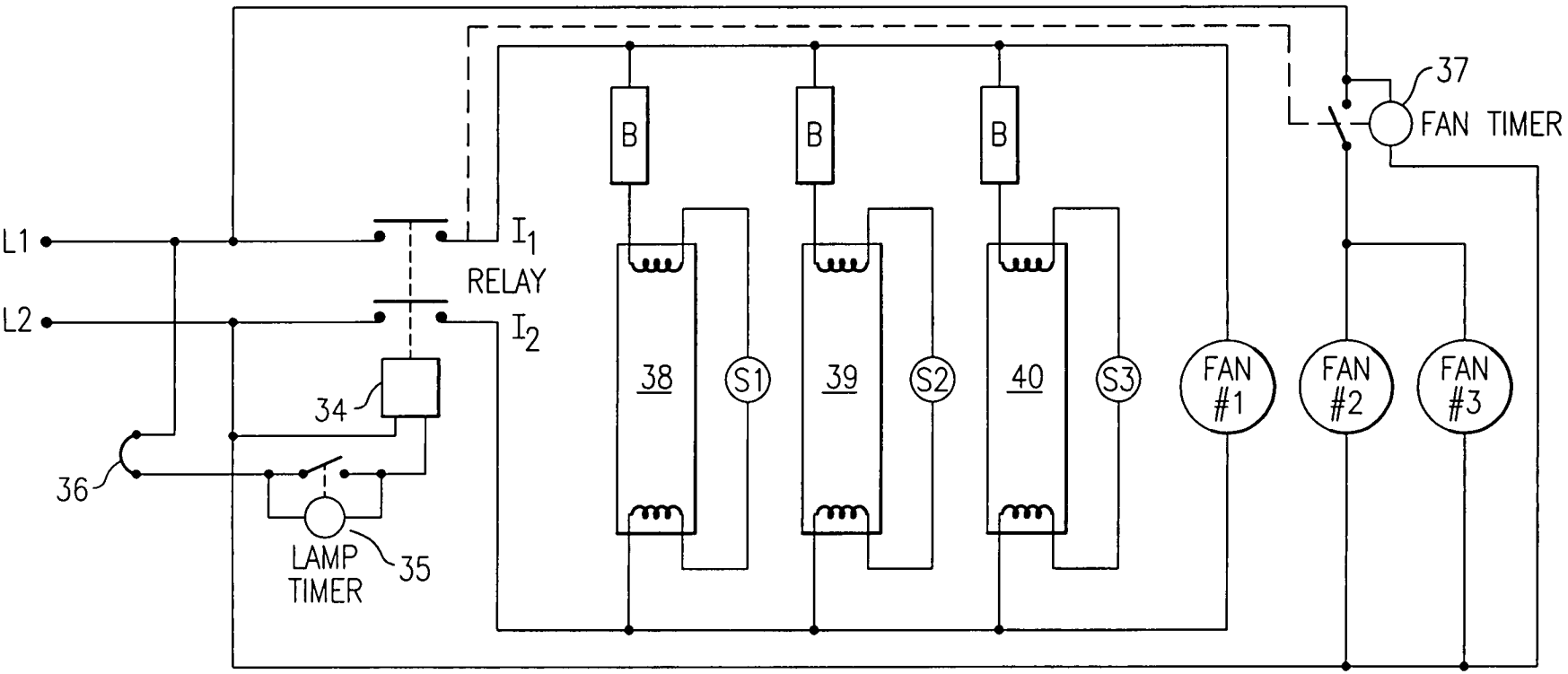
Figure 18:
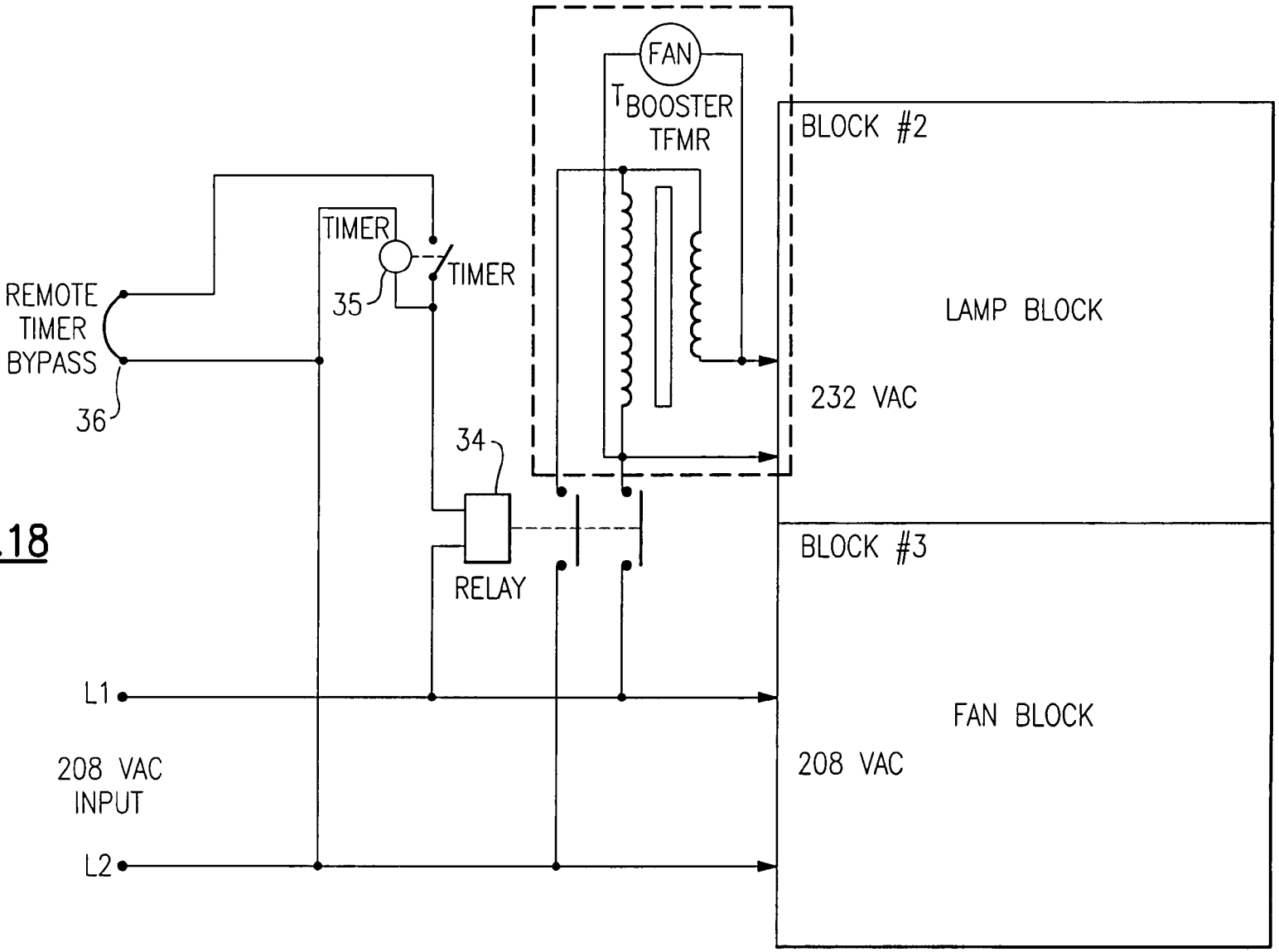
Figure 19:
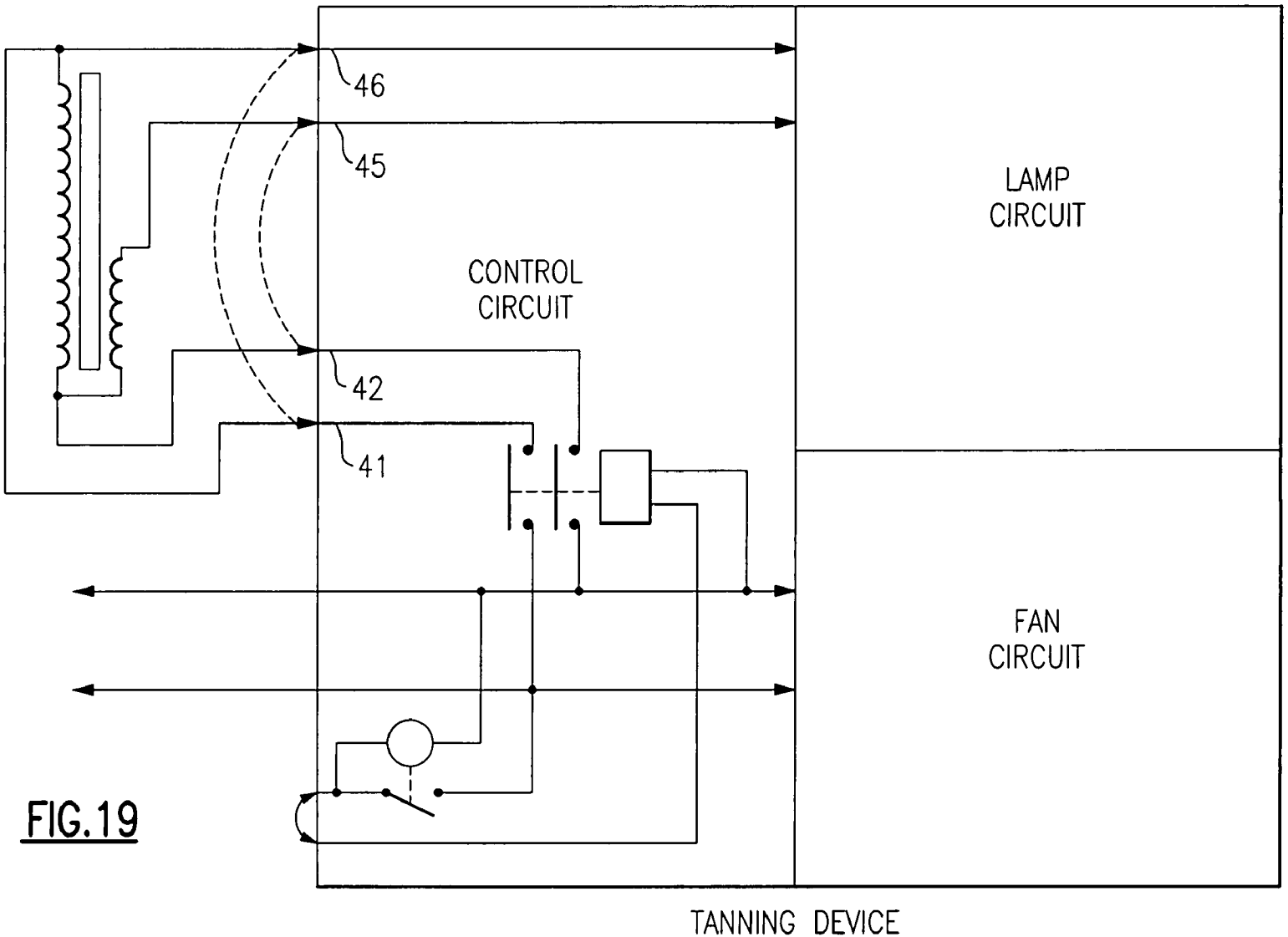
Figure 20:
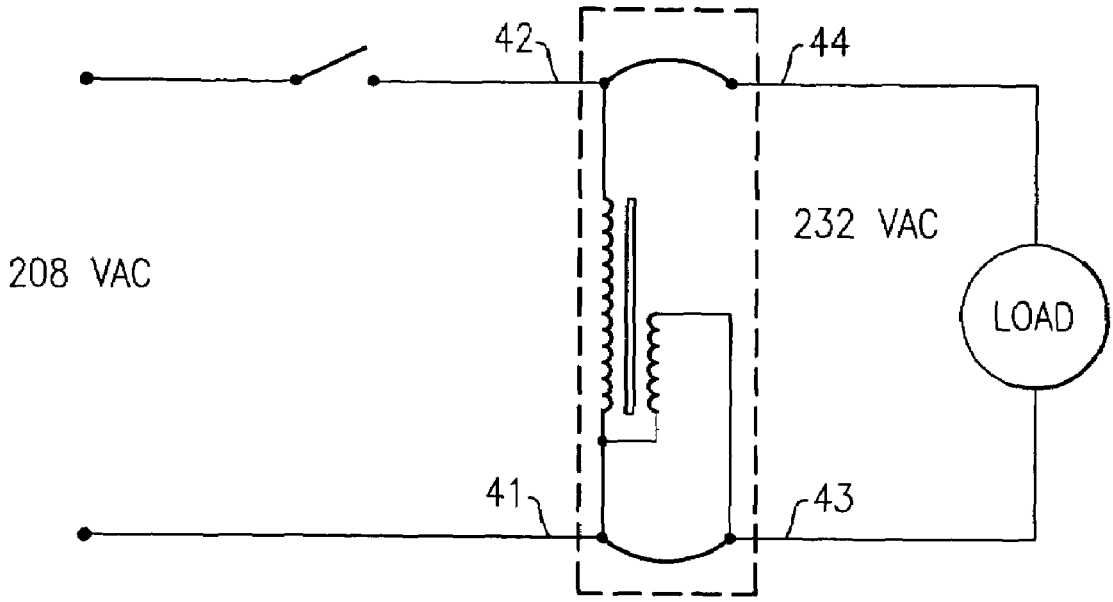
Figure 29:
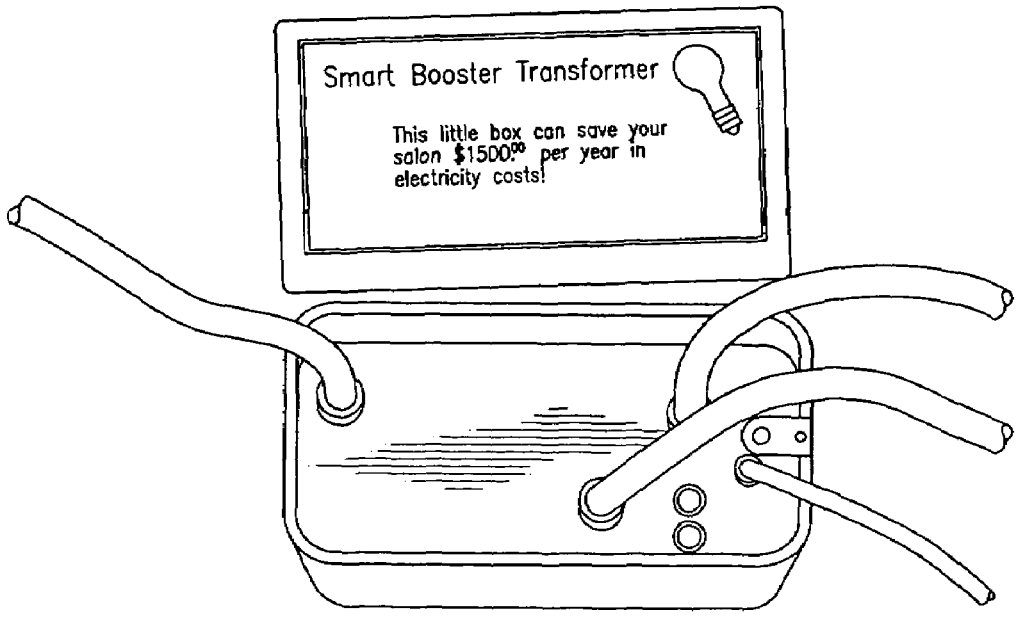
Figure 21:
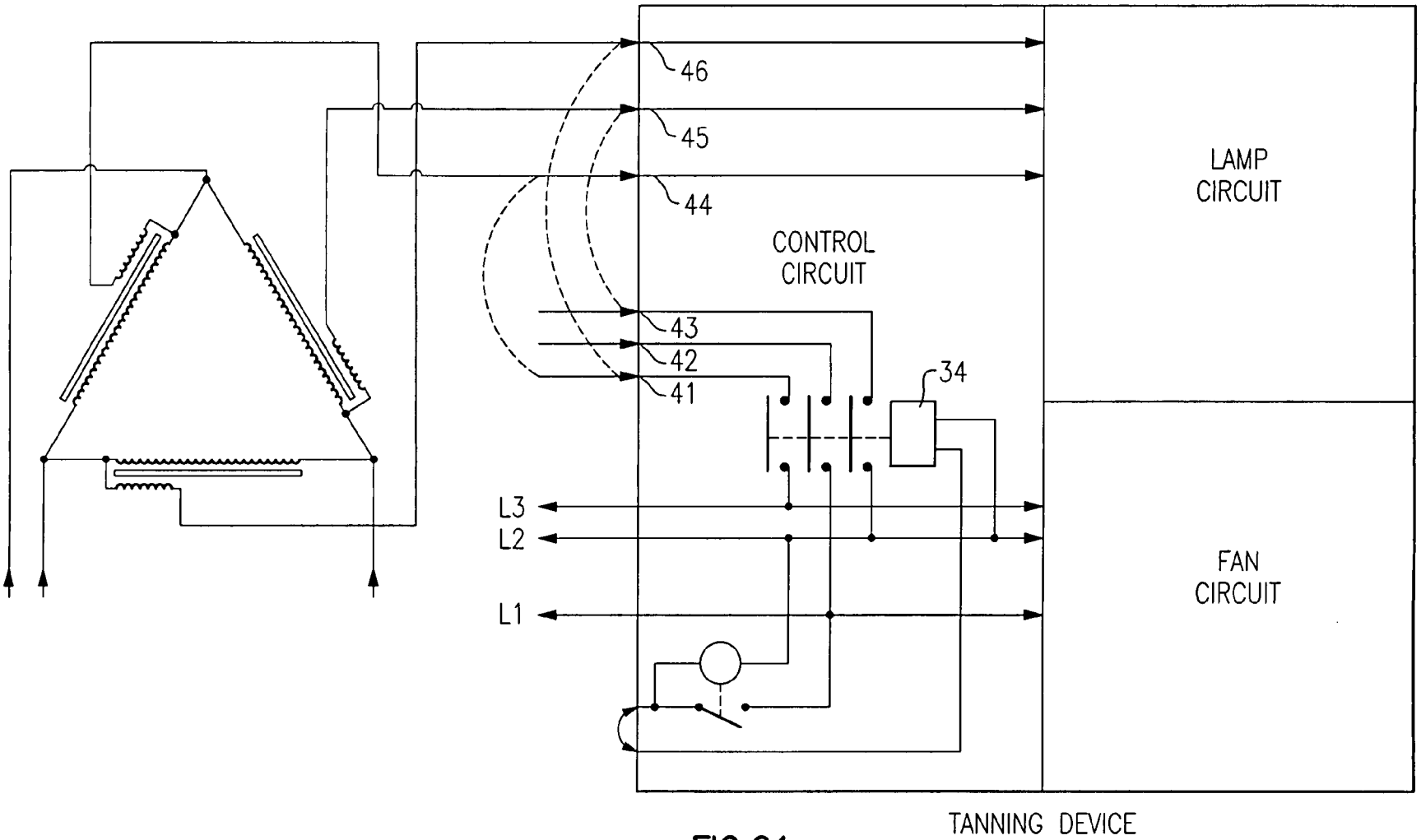
Figure 22:
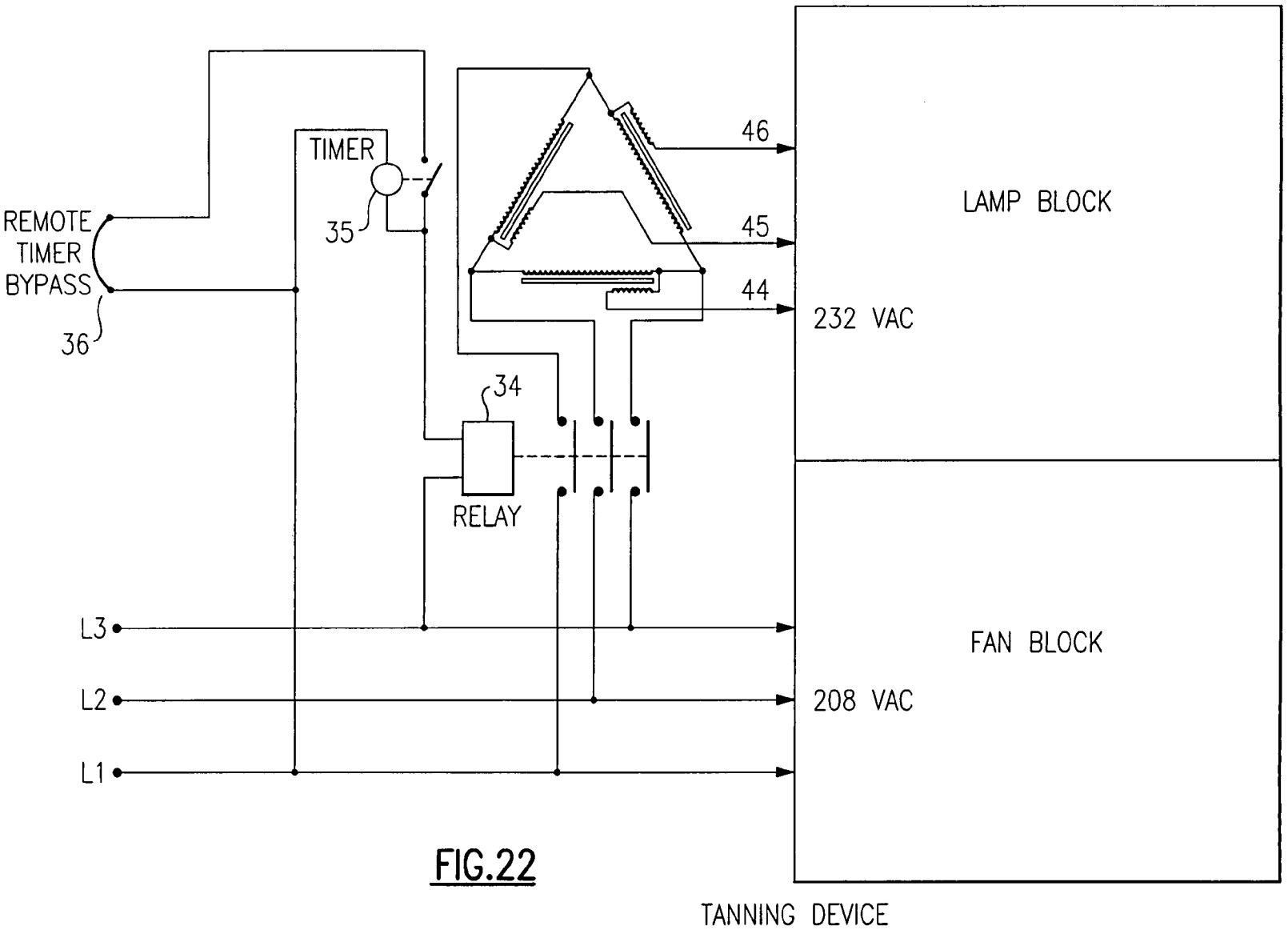
Figure 23:
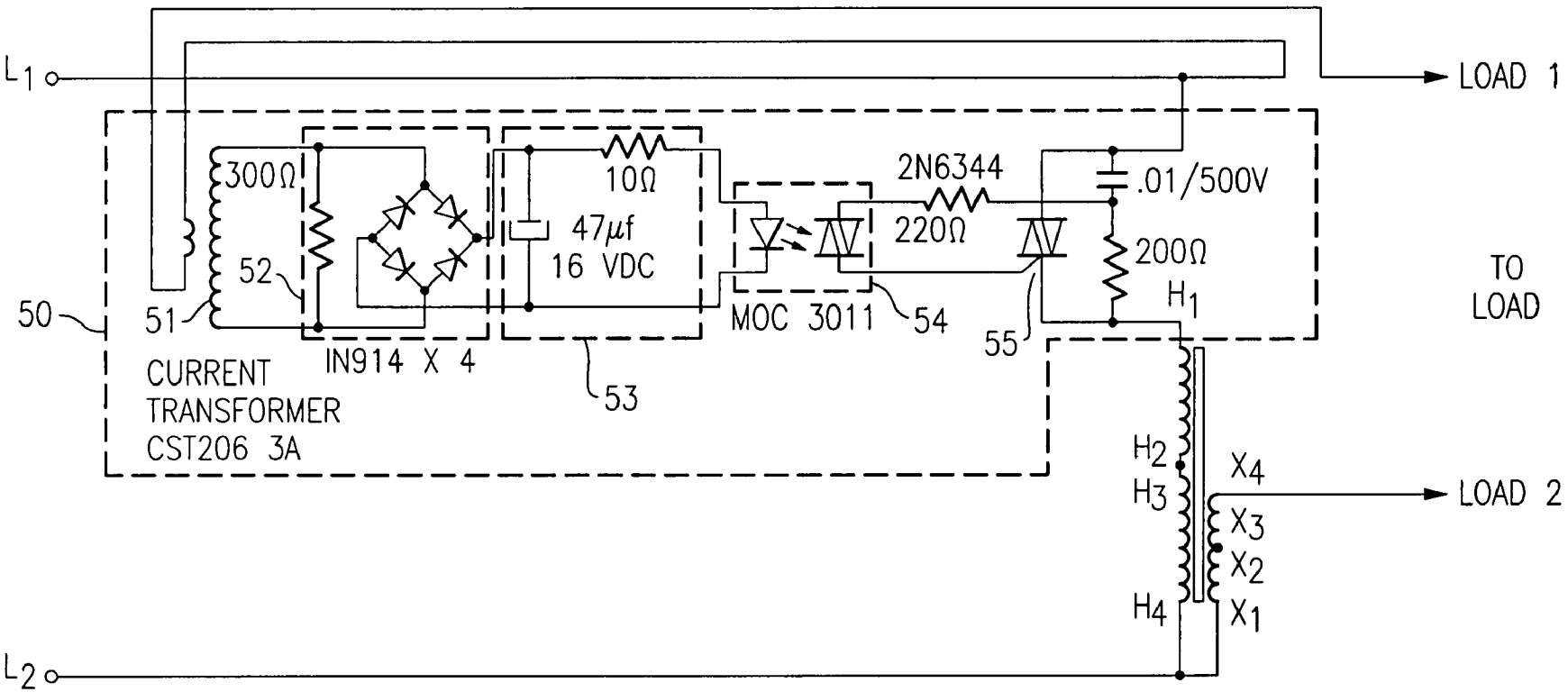
Figure 24:
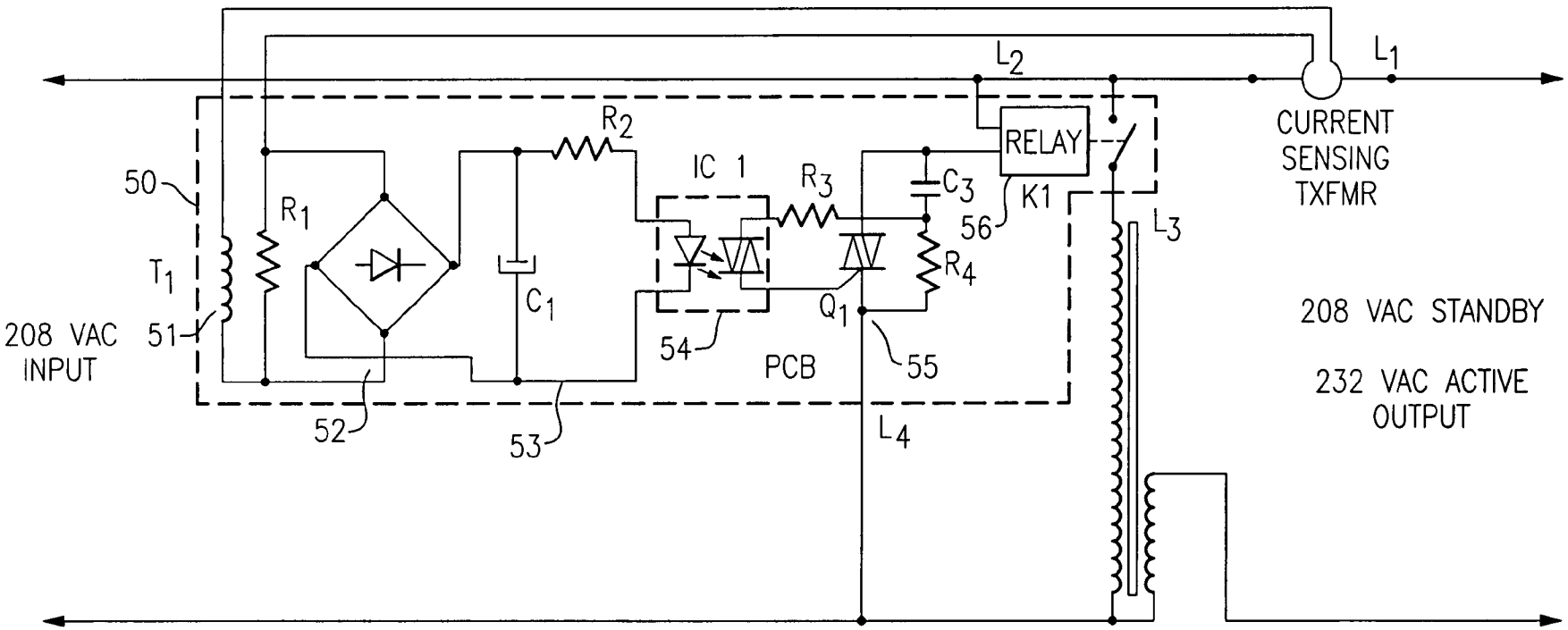
Figure 25:
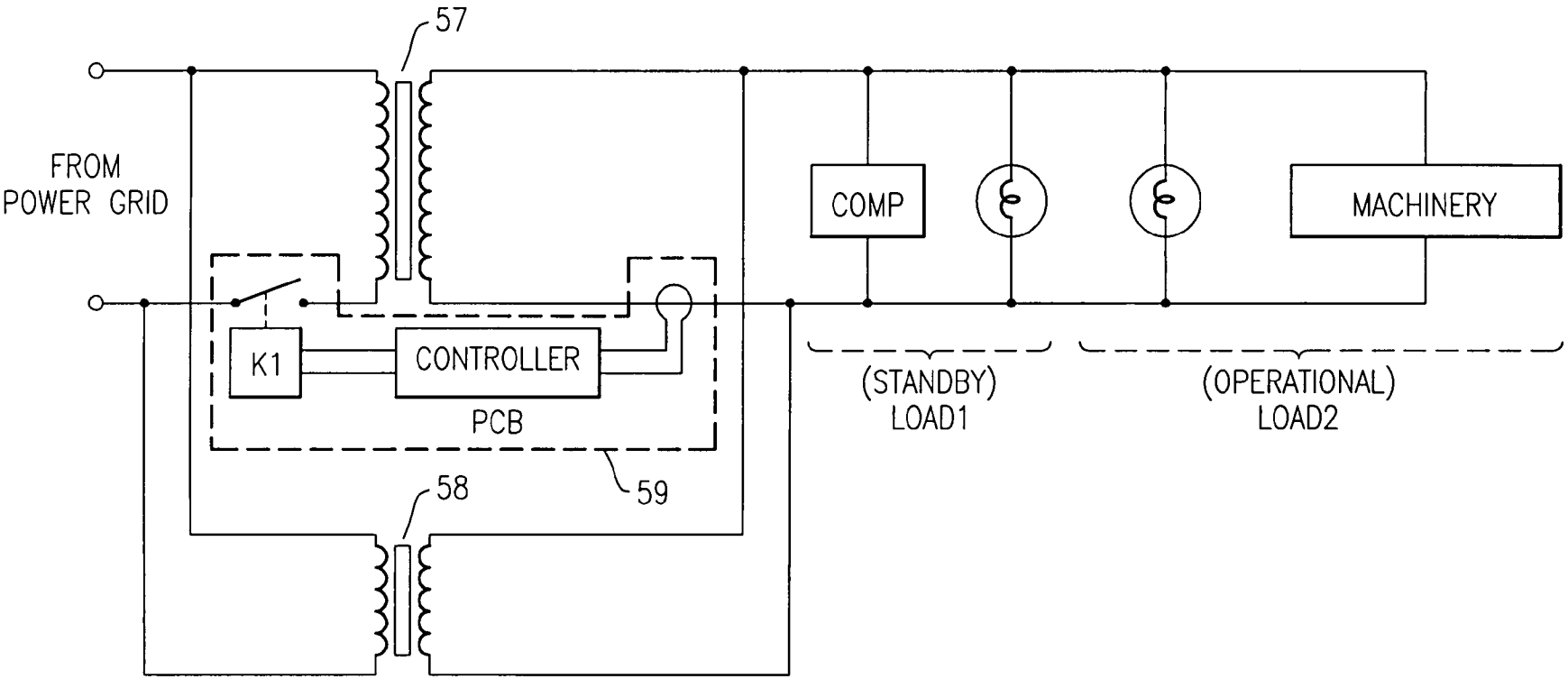
Figure 26:
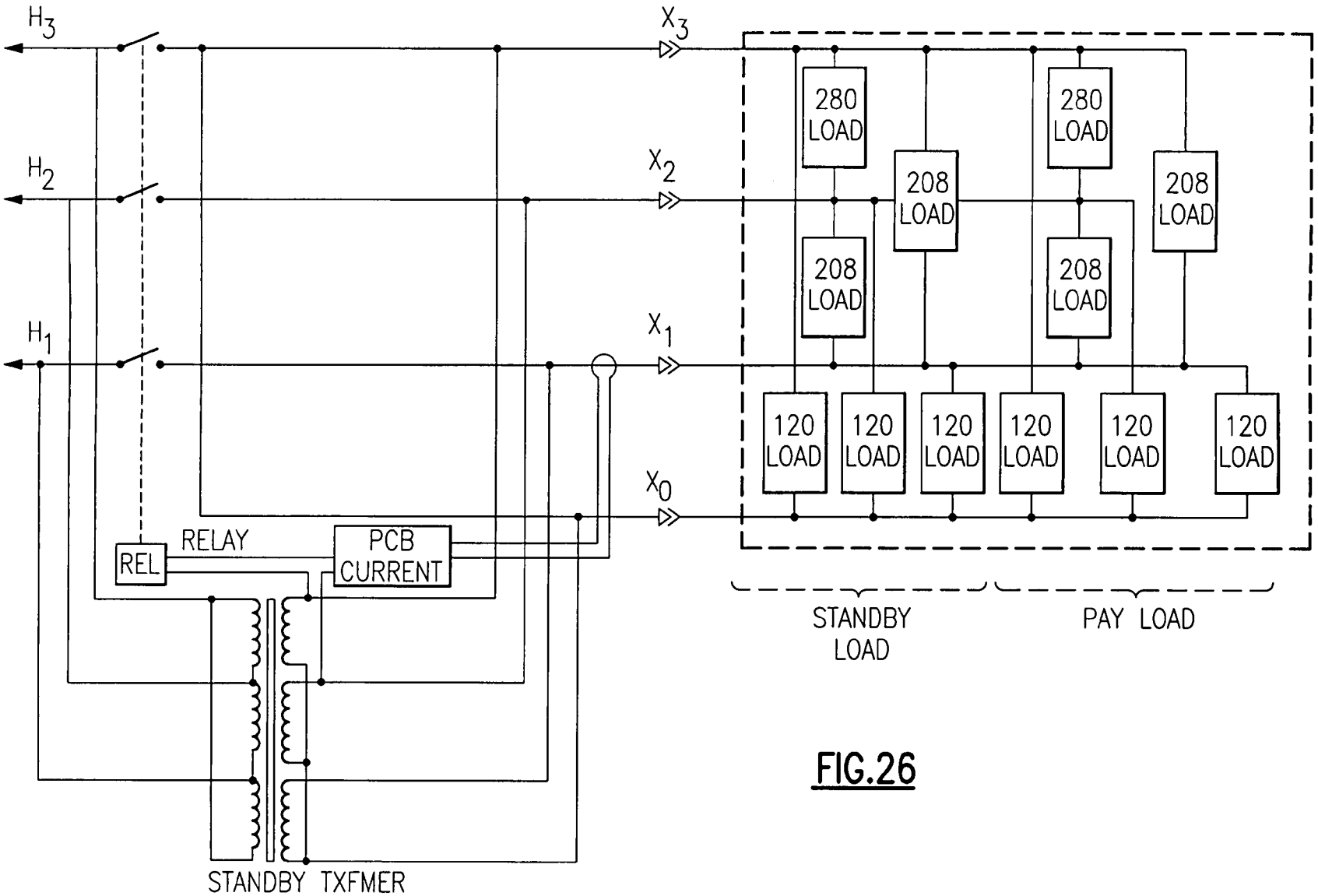
Figure 27:
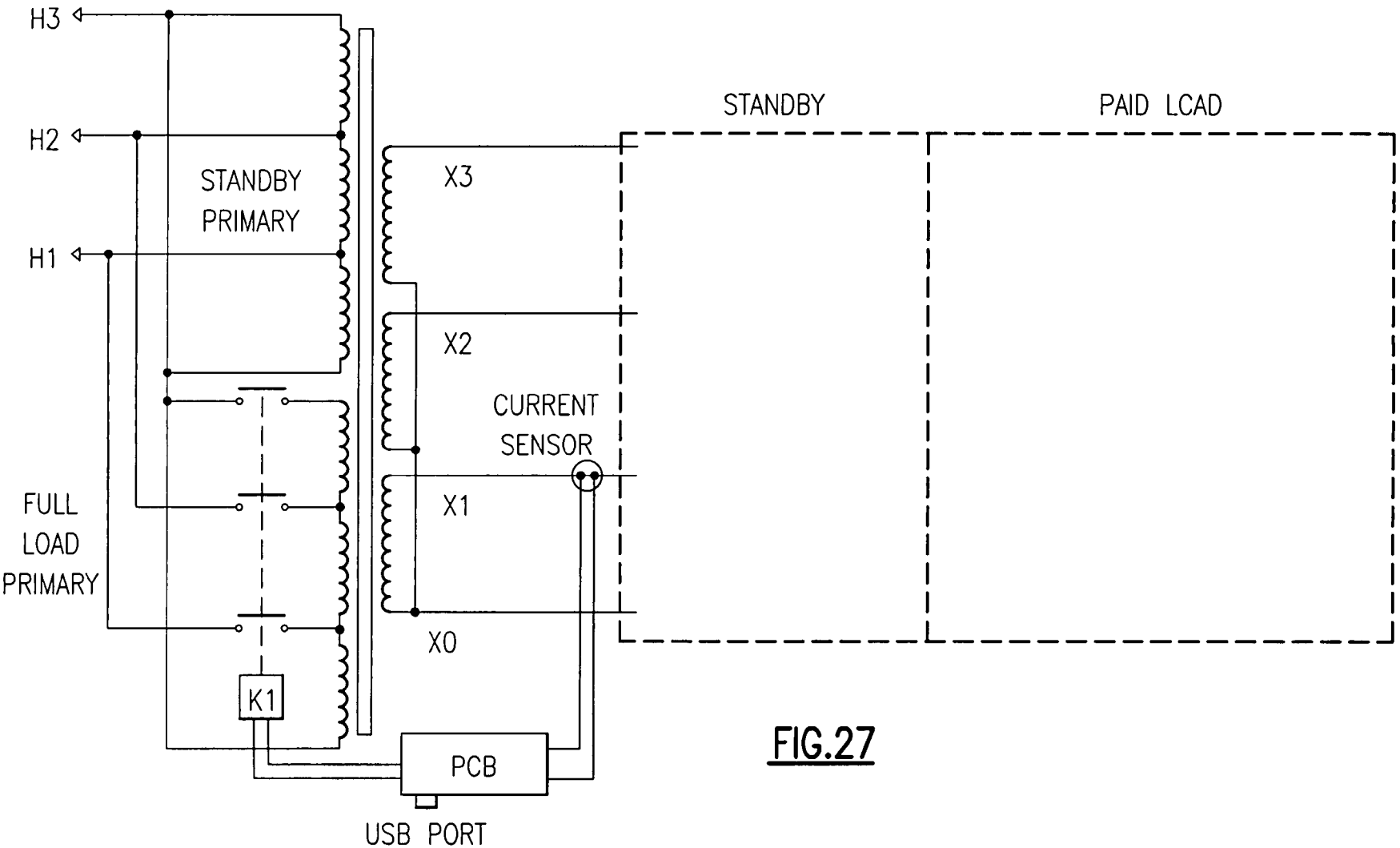
Figure 28:
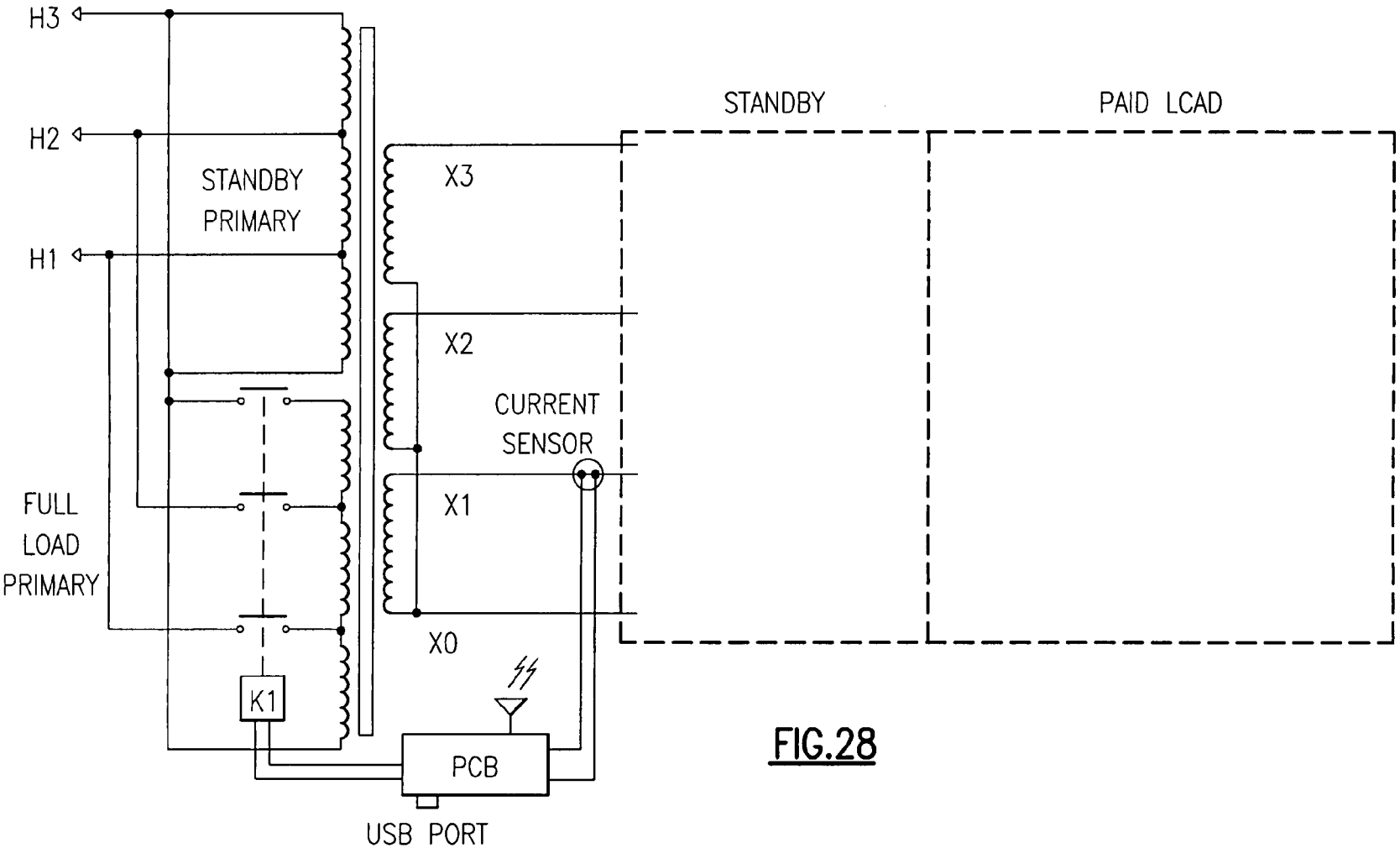

FIG. 4 presents a block diagram for a standby loss prevention transformer according to the present invention;

FIG. 5 shows a block diagram of another embodiment of the present invention;

FIG. 6 is a schematic representation of a transformer wired to an industrial motor in accordance with the present invention;

FIG. 7 shows a power saving module connected to a transformer according to the invention;

FIG. 8 illustrates a transformer wired to an air compressor according one another embodiment of the invention;

FIG. 9 is a schematic representation of yet another embodiment of the invention including a current sensing relay module;

FIG. 10 shows still another embodiment of the invention having a transmitter and receiver for remotely placed load and transformer;

FIG. 11 illustrates a further embodiment of the invention with a timer device implemented in accordance with the FDA recommendations;

FIG. 12 is a schematic representation of a three-phase transformer according to another embodiment of the present invention;

FIG. 13 shows another three-phase transformer according to the present invention;

FIG. 14 is a schematic presentation of a further embodiment of a three-phase transformer with a standby loss prevention module connected in a wireless manner to a distantly located load and transformer;

FIG. 15 is a block diagram of a tanning device having a standby loss prevention module according to the present invention wired to a conventional transformer;

FIG. 16 shows one of several possible circuit diagrams for an Input and Control block of the tanning device according to the invention;

FIG. 17 is a schematic diagram of a tanning device with principal components illustrated therein;

FIG. 18 illustrates a tanning device including a transformer and a standby loss prevention module according to the present invention;

FIG. 19 shows wiring of tanning device when the user does not require a transformer;

FIG. 20 is a block diagram illustrating bypassing a transformer according to one aspect of the present invention;

FIG. 21 shows a schematic wiring diagram of a tanning device with a three-phase transformer according to present invention;

FIG. 22 is a schematic presentation of a tanning device including a three-phase transformer according to the present invention;

FIG. 23 is a schematic diagram of a transformer having a current sensing module according to present invention;

FIG. 24 shows a transformer according to present invention having a current sensing module with an increase load capacity and accuracy of triggering point;

FIG. 25 illustrates one of several possible embodiments of the present invention that can be employed in variety of industrial or residential complexes according to certain use aspects of the present invention;

FIG. 26 is a schematic wiring diagram of separate three-phase transformers for full load operation and standby requirements implemented in accordance with the present invention;

FIG. 27 is a schematic representation of a single transformer having multi-primary windings according to the present invention with a Printed Circuit Board (PCB) having a serial port communication member;

FIG. 28 shows a single transformer having multi-primary windings according to the present invention with a Printed Circuit Board (PCB) having a wireless communication member; and FIG. 29 is a pictorial representation of one physical implementation of the present invention.

DESCRIPTION OF THE INVENTION

The following description is provided in conjunction with the accompanying drawing figures which are to be fully considered as a part of this disclosure. The invention herein is being elaborated mainly referring to the booster type of transformers. A person skilled in the art, however, will appreciate that the various aspects of the invention can be readily applied to other types of transformers and a similarly elaborated description is possible for these embodiments.

Figure 1:
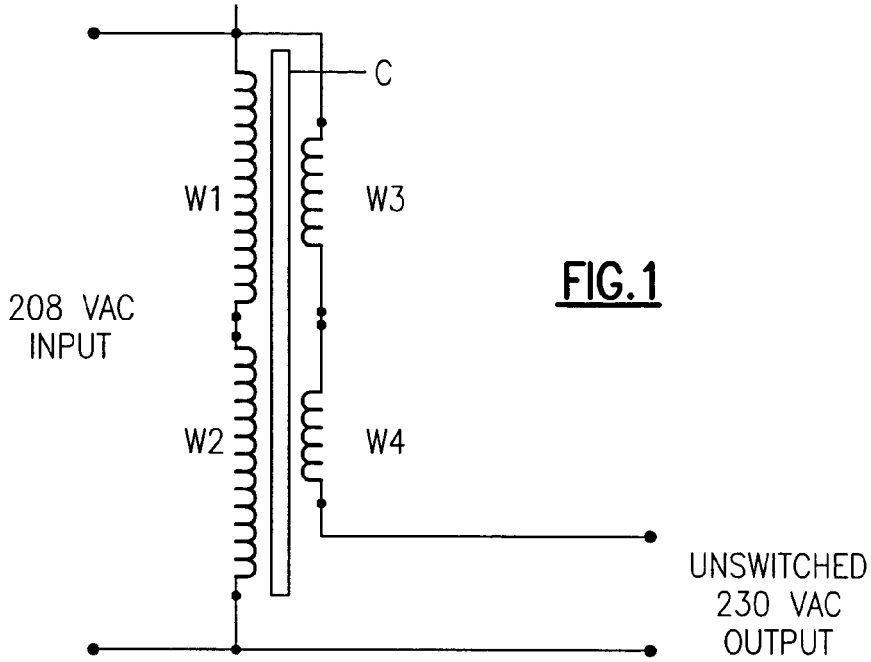
FIG. 1 shows a conventional single-phase transformer.

With reference now to FIG. 1, there is shown a conventional single-phase booster type transformer having four windings or coils W1, W2, W3, W4 and a core C. The windings W1 and W2 are high voltage input (primary) windings and are connected in series across the mains. The windings W3 and W4 are low voltage (secondary) windings and are connected in series with each other and the output nodes as shown in FIG. 1. This circuit exploits Lenz's law of induction for its operation. According thereto, a voltage across coils W1 and W2 creates a magnetic flux that is coupled to the windings W3 and W4 through the core C to induce a current in the windings W3 and W4. The current and voltage at the output are determined by the specification of the coils and the core. Normally, for a booster transformer, mains is a 208V AC supply and the output is 230V AC. Nevertheless, the output and mains specification can vary and thus the present invention is not limited to a particular mains or output specification.

Figure 2:
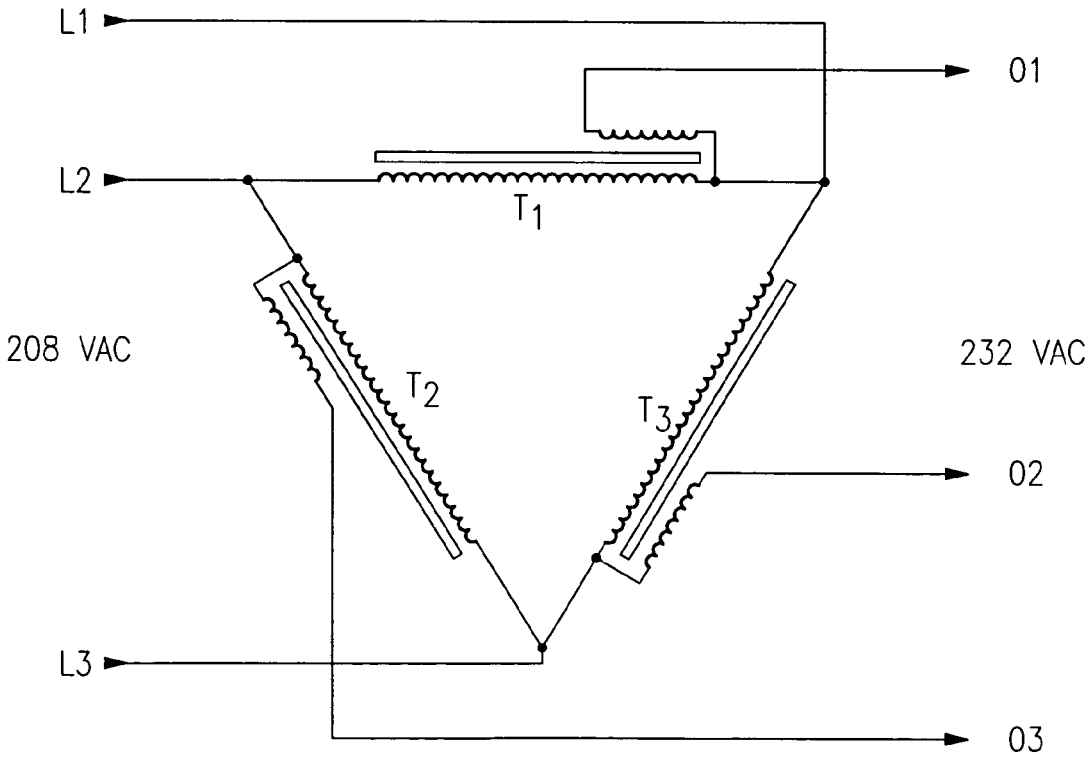
FIG. 2 illustrates a conventional three-phase transformer.

FIG. 2 shows a three-phase booster transformer. A three phase transformer includes three single phase transformers T1, T2, and T3 each connected across two lines L1-L2, L2-L3, and L3-L1 respectively to form a delta shape as shown in FIG. 2. The output phase is received from lines O1, O2, and O3 of the transformers T1, T2, and T3 respectively. The operating principle for this type of transformer remains the same as discussed above, except that a three phase input is provided at the inputs L1, L2, and L3 and a three phase output is observed at the O1, O2, and O3. A person skilled in the art will understand that at a given time only one transformer action corresponding to the dominant phase is useful. In this example, a three-phase input of 208 V AC fed to the transformer input L1, L2, and L3 and a three-phase output of 232V AC is received at the outputs O1, O2, and O3. The bucking configuration of the transformers can be achieved by swapping the input and output terminals and an isolation transformer configuration can be achieved by appropriately choosing winding and core specifications.

Figure 3:
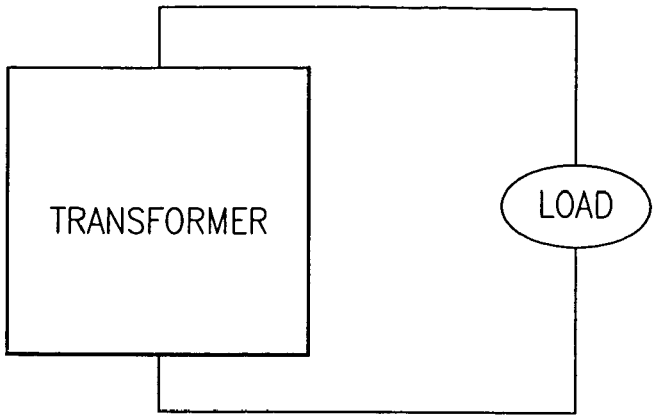
FIG. 3 shows a conventional block diagram for connecting a load and a transformer.

The conventional transformers of FIGS. 1 and 2 are typically directly connected to a load as shown in FIG. 3. These transformers have the disadvantage that they consume power even while the load attached is in standby mode.

To obviate above and other drawbacks of the prior art, the present invention provides a standby loss prevention module for transformers that can detect if a load connected to the transformer output is in operational mode and accordingly enables or disables the transformer thereby reducing the power consumed by the transformer.

Referring next to FIG. 4, there is shown a block diagram of an improved transformer with a loss prevention module according to present invention. The transformer of the invention has a sensing member or element connected to the load for sensing the state of operation of the load. This state sensing element provides a signal to the transformer enabling/disabling member. Whenever the load is in standby mode, the sensing element determines the functional state of the load and generates a signal for the transformer enabling/disabling member which in turn disables the transformer, thereby reducing the power consumed by the transformer during the standby mode of the load.

FIG. 5 shows one of the embodiments for connecting the sensing element or sensor and transformer enabling/disabling member or switch to the load and the transformer. According to this embodiment, a sensing element is connected across the load enabling/disabling member for sensing the state of the load enabling/disabling member, whenever the load is disabled the sensing element generates a signal for the transformer enabling/disabling member and disables the transformer to thereby prevent power consumption. A person skilled in the art will appreciate that many other similar embodiments are possible for wiring these blocks without departing from the concept of the present invention, one of them being connecting the sensing element across the load with the rest of the connections remaining the same. Other wiring implementations would be readily apparent to those of skill in the art given the present disclosure and the various objectives of this invention.

Without limiting the scope of the invention, some of the possible explicit circuit embodiments of the invention are described in the subsequent description.

With reference next to FIG. 6, there is shown a transformer wired to an industrial motor in accordance with the present invention. The transformer has primary windings 1, secondary windings 2, and the core 3. The primary winding 1 is provided with a relay switch 4. The relay 4 is connected across the load motor 6. When the motor switch 5 is enabled, the relay 4 gets charged that enables the primary winding 1 to conduct and initiate the transformer action. On the other hand, when the motor is not in operation mode the switch 5 is open then the relay 4 disables the primary winding 1 thereby achieving an objective of the invention.

The invention further provides a power saving module that can be connected to any conventional transformer and convert it to a power efficient transformer. The module is shown in FIG. 7. The power saving module is provided with a plurality of terminals 7, 8, 9, 10, and 11 that can be connected between the load and the transformer. The winding of the transformer is connected to the terminal 9 that connects the supply line 7 through a relay switch 4. The relay terminals 10 and 11 are connected across the load to detect the functional state of the load. The terminal 8 connects the supply line to the load. When the load switch 12 is closed the relay 4 of the module enables the transformer windings whereas if the load switch 12 is open the relay switch disconnects the winding from the mains, thereby discontinuing power consumption by the transformer during standby mode of the load.

FIG. 8 shows a transformer wired to an air compressor according to another embodiment of the present invention. In a typical air compressor, the motor is required to be switched on/off when the pressure in the air tank is below/above a predetermined pressure level. A pressure gauge based switch 13 is enabled or disabled according to the pressure requirements in the air tank. According to this embodiment of the invention, the primary winding 14 of the transformer is connected to mains L1 and L2 through a relay switch 16. The relay terminals 17 and 18 are connected across the load motor 19 and an additional conductor C1 is provided with the terminal 18 of the relay to connect line L2 of the mains thereby shorting the secondary winding 15. The additional conductor C1 acts as a conduit in standby mode, whereas in the active mode this conductor adds voltage to achieve a desired potential difference across the output terminals of the transformer. The line L1 is connected to one supply terminal of the load motor 19 through the pressure gauge based switch 13. When the air pressure in the tank is below a predetermined level, the pressure regulated switch 13 turns on the motor 19 to thereby charge the air tank. Once the air tank is appropriately charged and the pressure inside the tank is sufficient enough that it disables the pressure switch 13 and hence disables the motor 19, the relay 16 is de-energized to disconnect the transformer from mains to save the power consumed in the standby mode of the motor. In this embodiment, all that is needed to benefit by this power saving technology is one added wire that connects line L2 to the terminal 18 as illustrated.

Another embodiment of the invention is shown in FIG. 9. This embodiment provides an auto-sensing current transformer. The transformer according to this embodiment includes a current sensing relay module 20 that further includes an operational amplifier 21 having one of its input connected to line L1 of mains to receive a reference signal, a second input of the operational amplifier 21 is connected to the ground through a resistor 22 and the output is connected to relay 23. The operational amplifier 21 is designed to trigger the relay 23 at a predetermined signal level. Whenever the load 24 draws enough current to produce a signal that passes through the predetermined level, the relay 23 is triggered by the operational amplifier 21 for enabling/disabling the transformer. The predetermined signal level is defined according to transformer action requirements by the load.

More particularly, when the load 24 is enabled the operational amplifier 21 detects current flowing through load 24 and provides a signal that energizes the relay 23 to enable the transformer. On the other hand, when the load 24 is disabled the operational amplifier 21 observes zero current flow and then de-energizes the relay to disconnect the transformer to thereby put it in the power saving mode.

FIG. 10 shows a standby loss prevention transformer that can be connected to a remotely located load and transformer assembly without requiring additional long running wires. According to this embodiment, a transmitter 25 is connected across the load 26 for detecting the functional state of the load 26. A receiver 27 is provided with the transformer as shown. The receiver 27 controls a switch S1 that enables or disables the transformer. When the load is in active mode, a second switch 28 connected to the load closes, and the transmitter 25 is then powered to transmit a signal to the receiver 27. On receipt of the signal, the receiver 27 enables the transformer to initiate the transformer action. In the standby mode of the load 26, the transmitter 25 transmits a signal for the receiver 27 to disable the transformer thereby achieving objects of the invention.

FIG. 11 shows another embodiment of a booster having a time delay relay (TDR) 29 with timer device 30 according to the US Food and Drug Administrations' (FDA) recommendations for avoiding tanning effects. In this embodiment, a removable Junction or jumper 31 is connected across the timer device 30 for providing a remote control operation. In this embodiment the relay 29 is connected across the line L1 and L2 through the parallel combination of the timer device 30 and jumper 31. By removing the jumper 31, an actuator switch S2 of the timer 30 is disconnected from the power source therefore control of the tanning is inhibited. The arrangement of the jumper 31 allows inserting of additional circuitry (if desired) required for enabling remote operation from hundreds of feet away as discussed above with reference to FIG. 10. The timing adjustments of the timer device 30 are achieved by altering either pot or spring setting by means of a knob that can be turned externally, or slotted shaft for screwdriver setting. With this type of timer device 30 all kinds of timing functions can be handled; such as operate-time delay, release-time delay, generation of a delay interval with reset, sequence timing with repetition, pulse generation, and interval timing. Timer device 30 according to its settings activates and deactivates the relay 29, and the relay 29 accordingly enables or disables the transformer providing a power efficient transformer. A fan 32 is optionally connected to the output nodes of the transformer. Whenever transformer action takes place to drive a load, the fan 32 switches on for cooling the transformer.

As illustrated in FIG. 11, an AC signal (normally 208V AC) is applied at the input L1 and L2. When the dial (knob) of the timer is twisted, the timer switch S2 is closed, and AC supply powers the relay coil to enable the transformer only when needed to thereby eliminate standby power losses.

FIG. 12 shows a three-phase booster transformer according to the present invention. The three-phase booster transformer includes three single-phase transformers T1, T2, and T3 as generally discussed above in connection with reference to FIG. 2. The transformers T1, T2, and T3 of the three-phase transformer are provided with relays K1, K2, and K3 respectively for enabling or disabling their associated transformer. The relays K1, K2, and K3 are controlled by lines C1 and C2. As illustrated, lines C1 and C2 are connected to any two of the three-phase output lines O1, O2, and O3. Another output enabling relay K4 is provided to enable or disable the load. When the relay K4 energizes to enable the load, the control lines C1 and C2 energize the relay K1, K2, and K3 to enable the transformer. The transformer remains disabled when the load is in standby mode hence preventing power losses by the transformer during the standby mode of the load.

Referring now to FIG. 13, there is shown another three-phase transformer according to the present invention. The relay keys K1, K2, and K3 are wired to the transformer and control lines C1 and C2 as discussed in the preceding FIG. 12. In this embodiment, however, an additional key K4 is connected to the control line C2 as illustrated (or C1 alternatively). Key K4 receives its input from an operational amplifier (Op-amp) as shown. The operational amplifier in this embodiment is implemented herein as discussed above in connection with FIG. 9. The operational amplifier has one of its input connected to the transformer to receive a reference signal and the second input to ground. The operational amplifier is designed to trigger the relay K4 at a predetermined signal level. In this manner, when the load draws sufficient current to produce a signal that passes through the designed threshold signal level, the relay K4 is triggered and hence keys K1, K2, and K3 are triggered to enable or disable the transformer.

FIG. 14 presents a further embodiment of a three-phase transformer with a standby loss prevention module that can be wirelessly connected to a far off separated load and transformer. As discussed above, this wireless aspect of the present invention illuminates the need of additional long running wires. According to this embodiment, a transmitter M1 is connected across the load for detecting the functional state of the load. A receiver R1 physically located in a distant location that is remote from the transmitter M1, is provided with the transformer as shown. The receiver R1 controls the relay key K4 that enables or disables the transformer. When the load is in active mode, the relay key K5 closes and the transmitter M1 is power to transmit a signal for the receiver R1. On receipt of the signal, the receiver R1 enables K4 and hence the keys K1, K2, and K3 to activate the transformer to initiate the transformer action. In the standby mode of the load, the transmitter M1 transmits a signal for the receiver R1 to disable the key K4 and hence the transformer to thereby achieve the desired power consumption reduction.

Now with reference next to FIG. 15, there is shown a block diagram of a tanning device having a standby loss prevention module according to the present invention wired to a conventional transformer. Tanning beds and booths come in a variety of models, from 24,100 Watt lamps to 60,160 Watt lamps. They are very power hungry devices and hence it is highly desirable to eliminate ineffective consumption of power from these devices. The tanning device according to this embodiment has three basic blocks. These include an Input and Control block, a Lamp block, and a Cooling block as illustrated. The Input and Control block is designed such that it disables the transformer when the tanning device is not functional thereby eliminating the power consumed by the transformer in the standby mode of the tanning device. During the operation of the tanning device, the Lamp block generates a great amount of heat, which increases the temperature of the device. The Cooling block is provided to keep the temperature under control. The Lamp block is very sensitive to the voltage and for a proper operation of the device it is required to supply an appropriate voltage.

FIG. 16 shows one of the possible circuit diagrams according to the invention for the Input and Control block of the tanning device of FIG. 15. The Input and Control block receives input supply from lines L1 and L2, which is then supplied to the Cooling block and the Lamp block through a relay 34. At one leg of the relay 34, a jumper 36 is provided with a timer device 35. The jumper 36 by passes the timer 35 to enable remote operation. This arrangement disables the transformer when the tanning lamps are not functioning thereby reducing power consumed by the transformer during the standby mode of the tanning device.

FIG. 17 shows an explicit diagram of a tanning device with minimal components for the purpose of necessary description only. A person suitably skilled in the art would thus appreciate that generally tanning devices are more complicated than shown in FIG. 17. In this embodiment, the tanning device is provided with the standby loss prevention module including a relay 34 having a timer device 35 and jumper 36 at its one leg as illustrated. Cooling devices FAN1, FAN2, and FAN3 of the tanning device are also provided with another timer 37. The tanning device has lamps 38, 39, and 40 receiving the input supply from nodes I1 and I2. The power is supplied to the tanning device from the lines L1 and L2 (normally 232V AC) through the standby loss prevention module. The relay 34 is interposed between the input nodes I1-I2 and the supply lines L1-L2 as shown. The other timing device 37 is interposed, as illustrated, between the supply and the cooling device FAN2 and FAN3 that optimally control the cooling operation.

Hereinafter, all the timing devices discussed herein without excluding the timing device 30 discussed in FIG. 11 and the timing devices 35 and 37 of FIG. 17 are timing devices that can be any suitable timing device including simple spring base timing devices and highly sophisticated microcontroller/microprocessor based timing devices.

With continuing reference to FIG. 17, when the timer device 35 is activated an AC supply starts charging relay 34. When the relay is sufficiently charged it establishes connection between the lines L1-L2 and I1-I2, thereby enabling the lamps 38, 39, and 40, and the cooling device FAN1. The timing device 37 triggers the cooling device FAN2 and FAN3. The time for triggering the cooling device FAN2 and FAN3 is determined optimally depending on temperature and/or total time of continuous operation of the tanning device. When the tanning session exhausts, relay 34 gets de-energized disconnecting the lines L1-L2 and I1-I2 thereby disabling everything receiving power from lines L1 and L2. The cooling device FAN2 and FAN3 may remain running depending upon the preset delay and/or temperature and/or any other parameter as defined thereto for this purpose. The jumper 36 is connected for enabling remote operation of the tanning device if desired.

Referring next to FIG. 18, there is shown a tanning device encompassing the transformer and the standby loss prevention module within itself. The transformer is interposed between the relay 34 and the lamp block inputs L1 and L2. The mains L1 and L2 are connected to the relay 34 through the timing device 35 and jumper 36 as shown. The operation of the circuit remains the same as discussed for the previous FIG. 16. Here, the transformer is wholly encompassed within the tanning device.

FIG. 19 shows wiring of a tanning device when the use thereof does not require a transformer. The tanning device is provided with the paired sockets 41, 42 and 43, 44 that can be connected using jumpers to by pass the transformer. This saving power wiring system adds no additional cost to tanning device makers. FIG. 20 shows an effective block diagram for bypassing the transformer.

With reference next to FIG. 21, there is shown a wiring diagram of the tanning device for a three-phase transformer. Lines L1, L2, and L3 are mains lines 41, 42, and 43 are transformer input lines and lines 44, 46, and 46 are the transformer output lines connected to the Lamp Circuit block. The relay 34 is connected to any two of the input mains. Each of the transformer input lines are connected to the mains through the relay switch as illustrated. Further, jumpers are optionally provided to short lines 41, 42, and 43 respectively to lines 44, 45, and 46 as shown in case the user does not require transformer operation.

FIG. 22 shows a tanning device encompassing a three-phase transformer according to the present invention. As illustrated, the transformer is interposed between the relay 34 and the lamp block inputs 44, 45, and 46. The mains L1, L2 and L3 are connected to the relay 34 through the timing device 35 and jumper 36 as shown. The operation and the circuit remains the same as discussed with reference to FIG. 18 where here, however, the single-phase transformer is replaced by a three-phase transformer.

As would be readily apparent to one of skill in the art, this invention can also be practiced with isolation and buck type of transformers without departing from the basic aspects described above. Nevertheless, some of the possible embodiments thereof are described in the subsequent description for the purpose of illustration. The embodiments described earlier and hereinafter are illustrative only and in no way is the invention intended to be limited to the embodiments as shown and illustrated.

Referring next to FIG. 23, there is shown a transformer according to the present invention having a current sensing module. The transformer according to this embodiment is provided with a current sensing and controlling circuit 50. The circuit 50 senses the current drawn by the load and turns the transformer on or off when the current drawn by the load is above or below a threshold current.

The current sensing circuit includes a current transformer 51 (normally a single turn primary transformer like CST2063A) that detects the current drawn by the load and converts it into a voltage signal. The current transformer is provided with rectifying and filtering circuits 52 and 53 at its output to rectify and filter the AC voltage signal generated by the current transformer. The rectifying circuit 52 can be any suitable rectifying circuit including a bridge rectifier having four (4 1N914s') diodes as shown. The RC filter circuit 53 then filters the rectified signal. The rectified and filtered signal is applied to an optically active device 54, (like opto-isolator MOC3011) which generates a triggering signal whenever the voltage signal crosses a threshold voltage. A triac based switch 55 (for example 2N6344) can be used for triggering the load-driving transformer to set it on or off as desired to thereby reduce the power consumed by the transformer.

An increased load driving capacity and precise triggering point setting of the current sensing circuit can be achieved by additionally providing a relay 56 as shown in FIG. 24. One leg of the relay 56 is connected to the supply line whereas the other leg is connected to the triac circuit 55. The triac circuit 55 has a charge tank including a resistor and a capacitor which is powered using one of the supply lines. When the current drawn by the load is substantially high to produce a trigger for the triac circuit 55 as discussed earlier, the relay 56 starts charging for enabling the transformer. On the other hand, when the current drawn by the load is not substantially high enough the load-driving transformer remains disabled thereby reducing the power consumed by the transformer.

The circuits shown in FIGS. 23 and 24 are simple and economical circuits for basic applications where additional power supply for the current sensing circuit is not required since the current transformer 51 works as power supply to the opto-isolator.

Isolation transformers are used in distribution and are installed in more or less every industrial building or Business Park. The operating current requirement of an individual business or building varies widely and therefore the standby current requirement also, particularly for the instruments like night time lighting, security systems, computers, and other equipment requiring 24-hour power. The present invention can be exercised for reducing power consumption by the transformers used for powering these types of equipment.

FIG. 25, for example, shows one of the various possible embodiments that can be used in variety of industrial or residential complexes according to the present invention. According to this embodiment, a plurality of transformers including at least two transformers 57 and 58 each of different size and current rating are provided with the load. A current detecting and controlling module 59 is provided with each of the transformers or alternatively to any number of selected transformers. The current detecting and controlling module 59 selectively enables or disables one or more transformers according to the current requirements of the attached load the current detecting and controlling module may include a microcontroller, microprocessor, or a printed circuit board for the purpose of detecting current and accordingly enabling and disabling one or more transformers.

In the example illustrated in FIG. 25, it is assumed that the standby and full operating requirements are known. The transformer 57 is provided for full operating currents. Then when the current requirement can be met by the smaller transformer 58, as detected by the current detecting and controlling module 59, the larger transformer 57 is disabled, thereby providing a power efficient supply system.

FIG. 26 shows wiring of separate three-phase transformers for full load operation and standby requirements. A three phase transformer is connected between lines H1, H2, and H3 and lines X1, X2, and X3 for full load operating currents. The full load transformer is disconnected and the operation is taken over by another standby load transformer when the current detecting and controlling module detects that current requirements are below a threshold level. The threshold current can be defined according to the current requirements in business hours and business shut down hours.

FIGS. 27 and 28 show a single transformer having multi-primary windings according to the present invention. According to this embodiment, all selected primary windings are disabled or enabled corresponding to the current requirements thereby reducing the power consumed by the transformer. This design can be tailored for each application using a Printed Circuit Board (PCB) control with serial port communication, FIGS. 27 and 28, or wireless communication as illustrated in FIG. 28. Through the software on the PCB and computer software, the trigger point of ON and OFF of any current level can be sent to the transformer via communication ports. Multi-primary windings on a single transformer, not necessarily limited to two as illustrated, at OEM for the new generation of the power saving transformer.

FIG. 29 provides a pictorial representation of one physical external implementation of the control device of the present invention as employed for use in conjunction with existing or previously installed tanning equipment.

While this invention has been described in detail with reference to certain preferred embodiments, it should be appreciated that the present invention is not limited to those precise embodiments. Rather, in view of the present disclosure, which describes the current best mode for practicing the invention, many modifications and variations would present themselves to those of skill in the art without departing from the scope and spirit of this invention. The scope of the invention is, therefore, indicated by the following claims rather than by the foregoing description. All changes, modifications, and variations coming within the meaning and range of equivalency of the claims are to be considered within their scope.

What is claimed is:

1. A standby loss prevention module for use with a transformer, said module comprising:

a sensor connected to a load associated with a transformer;

communication means operatively linked with said sensor, said communication means for detecting a mode of load operation and communicating a corresponding load operation signal, and;

a control switch connected to said transformer, said control switch enabled to receive said load operation signal and deactivate said transformer when said load is in a predetermined mode.

2. The standby loss prevention module according to claim 1 wherein said sensor is selected from the group including voltage sensors, current sensors, and resistance sensors.

3. The standby loss prevention module according to claim 2 wherein when said sensor is a voltage sensor, said sensor is selected from the group of coil sensors, potential divider sensors, and feedback controlled voltage sensors.

4. The standby loss prevention module according to claim 1 wherein said sensor is an operational amplifier having a threshold defining means at an input thereof, said operational amplifier receiving at least one input from said load and having an output thereof connected to said control switch through said communications means.

5. The standby loss prevention module according to claim 4 wherein said threshold defining means is a potential divider connected to a second input of said operational amplifier.

6. The standby loss prevention module according to claim 2 wherein when said sensor is a current sensor, said sensor comprises:

a sensing transformer connected in series with at least one supply line, said sensing transformer sensing current drawn by said load and converting the current drawn into a voltage signal; and a rectifier and filter circuit connected to an output of said sensing transformer for rectifying and filtering said voltage signal.

7. The standby loss prevention module according to claim 1 wherein said communication means is implemented in a form including physical wires, wireless transmitters and receivers, transceivers, and optically active devices.

8. The standby loss prevention module according to claim 7 wherein said wireless transmitter is connected to said sensor and said receiver is connected to said control switch.

9. The standby loss prevention module according to claim 7 wherein said optically active device is an opto-isolator.

10. The standby loss prevention module according to claim 1 wherein said control switch is connected to said communications means and selected from the group including semiconductor switches and spring based relay control switches.

11. The standby loss prevention module according to claim 1 wherein said control switch is a triac device connected to said communication means.

12. The standby loss prevention module according to claim 10 wherein when said switch is a relay control switch, said switch includes a conductor to short a secondary winding of the transformer in pressure regulator applications.

13. The standby loss prevention module according to claim 1 wherein said control switch includes a timing device for controlling enable-time.

14. The standby loss prevention module according to claim 13 wherein said timing device is selected from the group including spring based timers, microcontroller based timers, and microprocessor based timers.

15. The standby loss prevention module according to claim 12 wherein said relay control switch includes a jumper for remotely controlling transformer operation.

16. The standby loss prevention module according to claim 1 wherein said transformer is a single or multi phase transformer.

17. The standby loss prevention module according to claim 1 wherein said transformer is a booster type, buck type, or isolation type transformer.

18. The standby loss prevention module according to claim 1 wherein said sensor and control switch are printed on a circuit board.

19. A transformer system having standby loss prevention module, said transformer system comprising:

a transformer implemented to receive an input and transform said input for use by a load;

a sensor connected between an output of said transformer and said load;

a communication link including said sensor and being connected between said transformer and said load, said sensor detecting a mode of load operation and communicating a corresponding load mode signal over said communication link, and;

a control switch connected to said transformer and sensor through said communicating link, said control switch deactivating said transformer when said load mode signal indicates that said load is in a standby mode to thereby prevent unnecessary power consumption.

20. The transformer system according to claim 19 wherein said transformer has a plurality of primary coils.

21. The transformer system according to claim 20 wherein selected primary coils from said plurality of primary coils are selectively activated and deactivated according to power requirements of said load.

22. The transformer system according to claim 19 wherein said transformer is a plurality of transformers.

23. The transformer system according to claim 22 wherein selected transformers from said plurality of transformers are selectively activated and deactivated according to power requirements of said load.

24. A method of reducing power consumption to an electrical device, said method comprising:

interposing a control switch between an electrical supply and a load device;

determining when the load device requires full-level operational power;

activating said control switch to interpose a step-up transformer between said electrical supply and said load device;

providing full-level operational power to the load device; and deactivating the step-up transformer when the load device is not in use.

* * * * *